US011913198B2

(12) United States Patent
Yamada et al.

(10) Patent No.: US 11,913,198 B2
(45) Date of Patent: Feb. 27, 2024

(54) WORK MACHINE

(71) Applicant: HITACHI CONSTRUCTION MACHINERY CO., LTD., Tokyo (JP)

(72) Inventors: Hiroyuki Yamada, Hitachinaka (JP); Katsumasa Uji, Tsukuba (JP)

(73) Assignee: HITACHI CONSTRUCTION MACHINERY CO., LTD., Tokyo (JP)

( * ) Notice: Subject to any disclaimer, the term of this patent is extended or adjusted under 35 U.S.C. 154(b) by 841 days.

(21) Appl. No.: 16/979,281

(22) PCT Filed: Jun. 10, 2019

(86) PCT No.: PCT/JP2019/022947
§ 371 (c)(1),
(2) Date: Sep. 9, 2020

(87) PCT Pub. No.: WO2020/003994
PCT Pub. Date: Jan. 2, 2020

(65) Prior Publication Data

US 2021/0047808 A1 Feb. 18, 2021

(30) Foreign Application Priority Data

Jun. 28, 2018 (JP) ..... 2018-122946

(51) Int. Cl.
*E02F 3/43* (2006.01)
*E02F 3/32* (2006.01)
(Continued)

(52) U.S. Cl.
CPC ..... *E02F 9/268* (2013.01); *E02F 3/43* (2013.01); *E02F 9/2004* (2013.01);
(Continued)

(58) Field of Classification Search
CPC . E02F 9/268; E02F 3/43; E02F 9/2004; E02F 9/2041; E02F 9/2203; E02F 9/2285;
(Continued)

(56) References Cited

U.S. PATENT DOCUMENTS

2012/0123564 A1* 5/2012 Yajima ..... G05B 19/19 700/33
2012/0173101 A1 7/2012 Peterson et al.
(Continued)

FOREIGN PATENT DOCUMENTS

JM 2014-502712 A 2/2014
JP 2001-254681 A 9/2001
(Continued)

OTHER PUBLICATIONS

Korean Office Action received in corresponding Korean Application No. 10-2020-7023887 dated Feb. 24, 2022.
(Continued)

*Primary Examiner* — Hunter B Lonsberry
*Assistant Examiner* — Daniel M. Robert
(74) *Attorney, Agent, or Firm* — Mattingly & Malur, PC

(57) ABSTRACT

A controller mounted in a hydraulic excavator includes: a state transition section that performs switchover between two types of control that are manual control and semiautomatic control, on the basis of input of a state switching signal; and a velocity transition section that changes a rate of change with time in a velocity of a boom cylinder from a first rate of change I1 to a second rate of change I2 greater than the first rate of change I1 in a case in which input to an operation lever changes since the state transition section switches over between the two types of control until the velocity of the boom cylinder changes to a velocity Vo(t) specified by the control after the switchover between the two types of control.

8 Claims, 14 Drawing Sheets

(51) Int. Cl.
*E02F 9/20* (2006.01)
*E02F 9/22* (2006.01)
*E02F 9/26* (2006.01)

(52) U.S. Cl.
CPC ..... *E02F 9/2041* (2013.01); *E02F 9/2203* (2013.01); *E02F 9/2285* (2013.01); *E02F 9/262* (2013.01); *E02F 3/32* (2013.01); *E02F 3/435* (2013.01); *E02F 9/2228* (2013.01); *E02F 9/2292* (2013.01)

(58) Field of Classification Search
CPC ... E02F 9/262; E02F 3/32; E02F 3/435; E02F 9/2228; E02F 9/2292; E02F 9/2207; E02F 9/2296; E02F 9/2025; B60W 60/005; G05D 1/0061
See application file for complete search history.

(56) References Cited

U.S. PATENT DOCUMENTS

| | | | | |
|---|---|---|---|---|
| 2014/0257646 | A1 | 9/2014 | Ishibashi et al. | |
| 2017/0247861 | A1 | 8/2017 | Matsuyama et al. | |
| 2017/0268204 | A1* | 9/2017 | Shimano | E02F 3/435 |
| 2018/0251959 | A1* | 9/2018 | Fujii | E02F 9/2012 |
| 2018/0373244 | A1* | 12/2018 | Augst | B60W 30/10 |
| 2019/0040605 | A1* | 2/2019 | Kobayashi | E02F 9/2282 |
| 2019/0106861 | A1 | 4/2019 | Izumi et al. | |
| 2019/0382009 | A1* | 12/2019 | Iwasa | G08G 1/0969 |
| 2020/0117192 | A1* | 4/2020 | Satoh | B62D 6/00 |
| 2020/0224385 | A1* | 7/2020 | Saigo | E02F 3/439 |
| 2021/0047808 | A1* | 2/2021 | Yamada | E02F 9/268 |

FOREIGN PATENT DOCUMENTS

| | | | |
|---|---|---|---|
| JP | 2014-173321 | A | 9/2014 |
| WO | 2016/111384 | A1 | 7/2016 |
| WO | 2018/008190 | A1 | 1/2018 |

OTHER PUBLICATIONS

International Preliminary Report on Patentability received in corresponding International Application No. PCT/JP2019/022947 dated Jan. 7, 2021.
International Search Report of PCT/JP2019/022947 dated Sep. 3, 2019.
Chinese Office Action dated Dec. 1, 2021, issued in corresponding CN Application No. 201980014750.5.

* cited by examiner

VECTOR V0 BEFORE CORRECTION BASED ON DISTANCE d

VECTOR V1 AFTER CORRECTION BASED ON DISTANCE d

WORK MACHINE

TECHNICAL FIELD

The present invention relates to a work machine capable of actuating a work device in accordance with a preset condition.

BACKGROUND ART

Some work machines including a hydraulic excavator often have a control function (control of this type is often referred to as machine control, semiautomatic control, and the like) to acquire a position and a posture of a multijoint work device by a sensor and to cause an attachment attached to a tip end of the work device to be actuated along a target shape of an object to be worked. Such a work machine exercises manual control (often referred herein to as "first control") to control the work device on the basis of operator's input to an operation device (for example, operation lever) similarly to other ordinary work machines, and semiautomatic control (often referred herein to as "second control") to control the work device in accordance with a predetermined condition either irrespectively of an operator's operation on the operation device during the operation or using part of the operation.

Examples of the latter semiautomatic control include control over a velocity of the work device on the basis of a distance between the work device and a predetermined design surface (target excavation terrain profile). In the semiautomatic control of this type, if the attachment deviates from, for example, a range where the target surface is present, then the distance between the work device and the design surface becomes unclear; thus, it is considered that it is impossible or unnecessary to continue the semiautomatic control and that control over the work device is switched from the semiautomatic control to the manual control. However, if there is a gap between a moving velocity of the attachment specified in the semiautomatic control and a moving velocity of the attachment specified in the manual control, a sudden velocity change generated at a time of switchover of control possibly turns a machine body into an unstable state. To suppress occurrence of this phenomenon, there is known a method of imposing limitations on an amount of change in the velocity of the work device since the switchover of control and gradually changing the velocity (refer to, for example, Patent Document 1).

PRIOR ART DOCUMENT

Patent Document

Patent Document 1: PCT Patent Publication No. WO2016/111384

SUMMARY OF THE INVENTION

Problems to be Solved by the Invention

First, in a method of Patent Document 1, when an operator inputs an operation to actuate the work device to move downward, for example, at a time of or immediately after switchover of control from the semiautomatic control to the manual control while the work device is actuated to move upward by the semiautomatic control, the work device moves upward for fixed time against the operator's operation, possibly resulting in operator's feeling of strangeness.

Next, in Patent Document 1, in a case in which a moving velocity of the work device at the time of switchover of control is equal to or higher than a threshold, the moving velocity of the work device is changed at a decrease rate equal to or higher than a decrease rate used in a case in which the moving velocity of the work device at the time of switchover of control is equal to the threshold. More specifically, in the case in which the moving velocity of the work device at the time of switchover of control is equal to or higher than the threshold, the decrease rate of the moving velocity is changed in such a manner that time t required before the moving velocity of the work device is equal to zero since the time of switchover of control (that is, time required before the work device starts action in a direction specified by control after switchover, or in other words, time for which the work device is not actuated in the direction specified by the control after switchover) is always equal to certain time tc. By doing so, in the case in which the moving velocity of the work device at the time of switchover is equal to or higher than the threshold, shortening the time for which the work device moves in an opposite direction to the direction specified by the control after switchover to make the moving velocity constant is intended to suppress the operator's feeling of strangeness.

In Patent Document 1, however, a limiting value for an amount of change (decrease rate) in the velocity of the work device is determined at the time of switchover of control and remains unchanged until the velocity of the work device reaches zero at least once. Owing to this, even if the operator thinks of promptly stopping the operation device and inputs an operation intended to stop the work device (for example, to return an operation lever to a neutral position) to the operation device, for example, after the switchover of control, then there occurs a state in which the work device is not promptly stopped and continues to be actuated for certain time against the operator's intention, and the operator possibly still has a feeling of strangeness.

An object of the present invention is to provide a work machine capable of suppressing a machine body from becoming unstable and advancing timing at which an operator's operation is reflected in an action of a work device in response to an operator's request.

Means for Solving the Problems

While the present application includes a plurality of means for solving the problems, an example of the plurality of means is as follows. A work machine includes: a work device; an actuator that drives the work device; an operation device for operating the actuator; and a controller that controls the actuator by any of two types of control that are first control to control the actuator on a basis of input to the operation device and second control to control the actuator on a basis of a distance between a predetermined design surface and the work device while the operation device is operated, the controller setting a limiting value for a rate of change with time in a velocity of the actuator to a first rate of change in case that switchover between the two types of control is performed on a basis of input of a state switching signal and the velocity of the actuator changes from a velocity specified by the control before the switchover out of the two types of control to a velocity specified by the control after the switchover, and changing the rate of change with time in the velocity of the actuator from the first rate of change to a second rate of change greater than the first rate of change in a case in which input to the operation device changes since the switchover between the two types of control is performed on the basis of the input of the state switching signal until the velocity of the actuator changes to the velocity specified by the control after the switchover.

Advantages of the Invention

According to the present invention, it is possible to suppress a machine body from becoming unstable during switchover of control and advance timing at which an operator's operation is reflected in an action of a work device in response to an operator's request.

MODES FOR CARRYING OUT THE INVENTION

Figure 1:
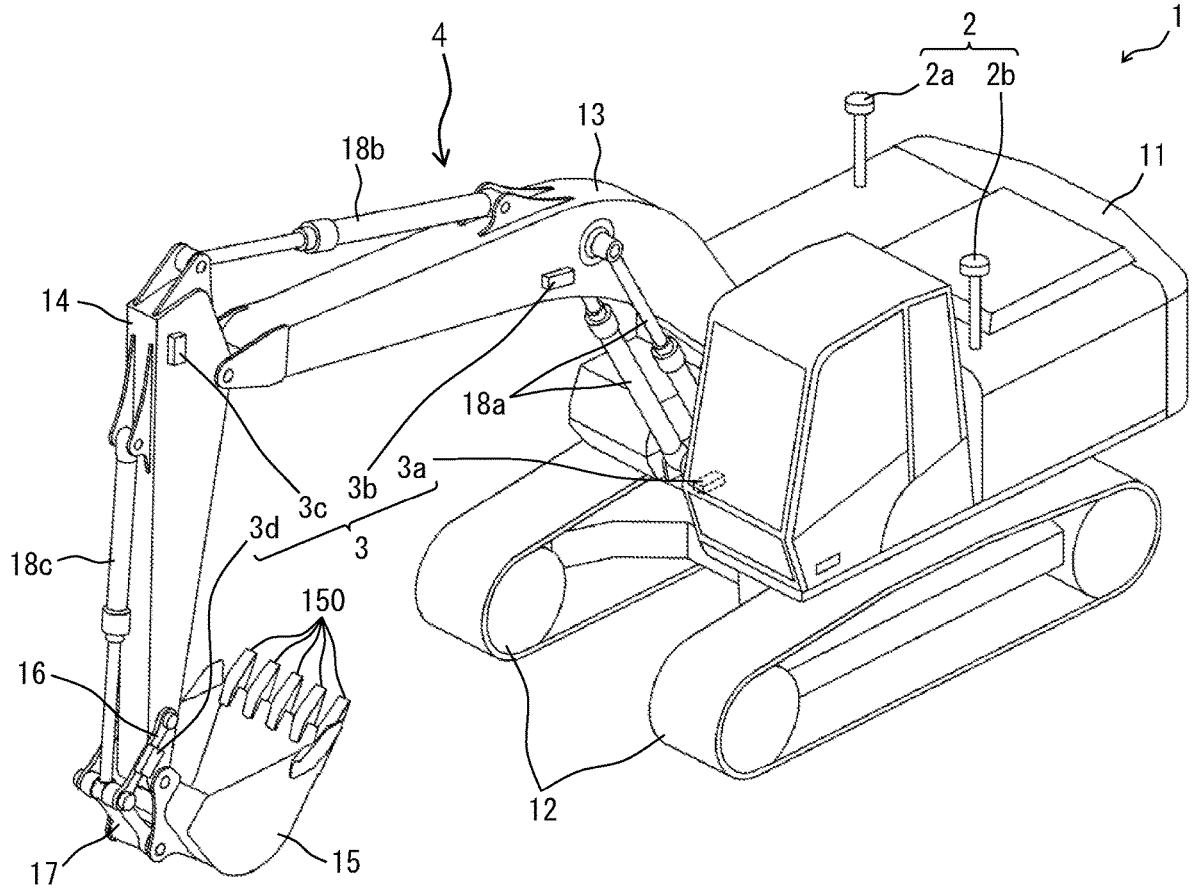
FIG. 1 is a perspective view of a hydraulic excavator according to Embodiment 1.

Embodiments of the present invention will be described hereinafter with reference to the drawings. In the following description, specific examples of a content of the present invention are described, the present invention is not limited to those described examples, and a person having ordinary skill in the art can make various changes and modifications within a scope of a technical concept disclosed in the present specification. In addition, in all drawings for describing the present invention, elements having same functions are denoted by same reference characters and repetitive description thereof is often omitted.

Embodiment 1

In Embodiment 1, a hydraulic excavator will be described as an example of a work machine. It is to be noted, however, that the work machine according to the present invention is not limited to the hydraulic excavator and the other work machine having a work device such as a bulldozer is also applicable as the work machine according to the present invention. A work machine according to Embodiment 1 will be described hereinafter with reference to FIGS. 1 to 7.

FIG. 1 depicts an outward appearance of the hydraulic excavator according to Embodiment 1. A hydraulic excavator 1 is configured with a lower track structure 12 including crawlers driven by a track hydraulic motor (not depicted), an upper swing structure 11 swingably attached to an upper portion of the lower track structure 12, and a multijoint work device (front work device) 4 rotatably attached to a front of the upper swing structure 11 and conducting work such as excavation. The upper swing structure 11 is driven to rotate by a swing hydraulic motor 19 (depicted in FIG. 2) relatively to the lower track structure 12.

The work device 4 is configured with a boom 13, an arm 14, a bucket 15, bucket links 16 and 17 that belong to elements configuring a four-joint link mechanism between the arm 14 and the bucket 15, a boom cylinder 18*a* driving the boom 13, an arm cylinder 18*b* driving the arm 14, a bucket cylinder 18*c* driving the bucket 15 via the bucket links 16 and 17 (the boom cylinder 18*a*, the arm cylinder 18*b*, and the bucket cylinder 18*c* will be referred to as hydraulic cylinders 18, as appropriate), and the like.

One end (a base end portion) of the boom 13 is rotatably supported by the upper swing structure 11. A bottom side (base end side) of the boom cylinder 18*a* is rotatably supported with respect to the upper swing structure 11, and a rod side (tip end side) thereof is rotatably supported with respect to the boom 13. The boom 13 is driven to rotate relatively to the upper swing structure 11 in response to expansion and contraction of the boom cylinder 18*a*. One end (a base end portion) of the arm 14 is rotatably supported by the other end (tip end portion) of the boom 13. A bottom side (base end side) of the arm cylinder 18*b* is rotatably supported with respect to the boom 13, and a rod side (tip end side) thereof is rotatably supported with respect to the arm 14. The arm 14 is driven to rotate relatively to the boom 13 in response to expansion and contraction of the arm cylinder 18*b*. The bucket 15 is rotatably supported by the other end (tip end portion) of the arm 14. One end of the bucket link 16 is also rotatably supported by the tip end portion of the arm 14. Furthermore, the other end of the bucket link 16 is rotatably supported by one end of the bucket link 17, and the other end of the bucket link 17 is rotatably supported by the bucket 15. A bottom side (base end side) of the bucket cylinder 18*c* is rotatably supported with respect to the arm 14, and a rod side (tip end side) thereof is rotatably supported with respect to the bucket link 16. In this way, the arm 14, the bucket links 16 and 17, and the bucket 15 configure the four-joint link mechanism, the bucket link 16 is driven to rotate relatively to the arm 14 in response to expansion and contraction of the bucket cylinder 18*c*, and the bucket 15 configuring the four-joint link mechanism is also driven to rotate relatively to the arm 14 in an interlocked manner with the bucket link 16 driven to rotate. The hydraulic excavator 1 configured in this way drives each of the boom cylinder 18*a*, the arm cylinder 18*b*, and the bucket cylinder 18*c* to have an appropriate stroke length, thereby making it possible to drive the bucket 15 to have an optional position and an optional posture and conduct desired work such as excavation.

It is noted that each of the boom 13, the arm 14, and the bucket (work tool) 15 is often referred to as front member. Furthermore, the boom 13, the arm 14, and the bucket 15 are actuated on a plane containing the work device 4, and this plane is often referred to as an action plane. In other words, the action plane is a plane orthogonal to rotational axes of the boom 13, the arm 14, and the bucket 15 and can be set at, for example, a center in width directions of the boom 13, the arm 14, and the bucket 15 (that is, a center of the rotation axis of each of the front implement members 13, 14, and 15).

Two GNSS (Global Navigation Satellite System) antennas 2*a* and 2*b* (which are collectively referred to as GNSS antennas 2 as appropriate) are disposed on the upper swing structure 11. The GNSS refers to a satellite positioning system that receives signals from a plurality of satellites and that recognizes a self position on Earth. The GNSS antennas 2 receive signals (radio waves) from a plurality of GNSS satellites (not depicted) located high up in the sky on Earth, and transmit the obtained signals to a GNSS controller 53 (depicted in FIG. 2), and the GNSS controller 53 computes positions of the antennas 2*a* and 2*b* from these signals.

A machine body IMU 3*a* (Inertial Measurement Unit) for measuring an inclination (inclination angle) of the upper swing structure 11 is attached to the upper swing structure 11. Likewise, a boom IMU 3*b* for measuring an inclination (inclination angle) of the boom 13 is attached to the boom 13, an arm IMU 3*c* for measuring an inclination (inclination angle) of the arm 14 is attached to the arm 14, and a bucket IMU 3*d* for measuring an inclination (inclination angle) of the bucket link 16 is attached to the bucket link 16 (IMUs 3*a* to 3*d* are referred to as IMUs 3, as appropriate). The IMUs 3 are sensor units that can measure an acceleration and an angular velocity, and data acquired by the IMUs 3 is output to a guidance controller 52 (depicted in FIG. 2). The IMUs 3 can function as posture sensors for the work device 4.

Figure 2:
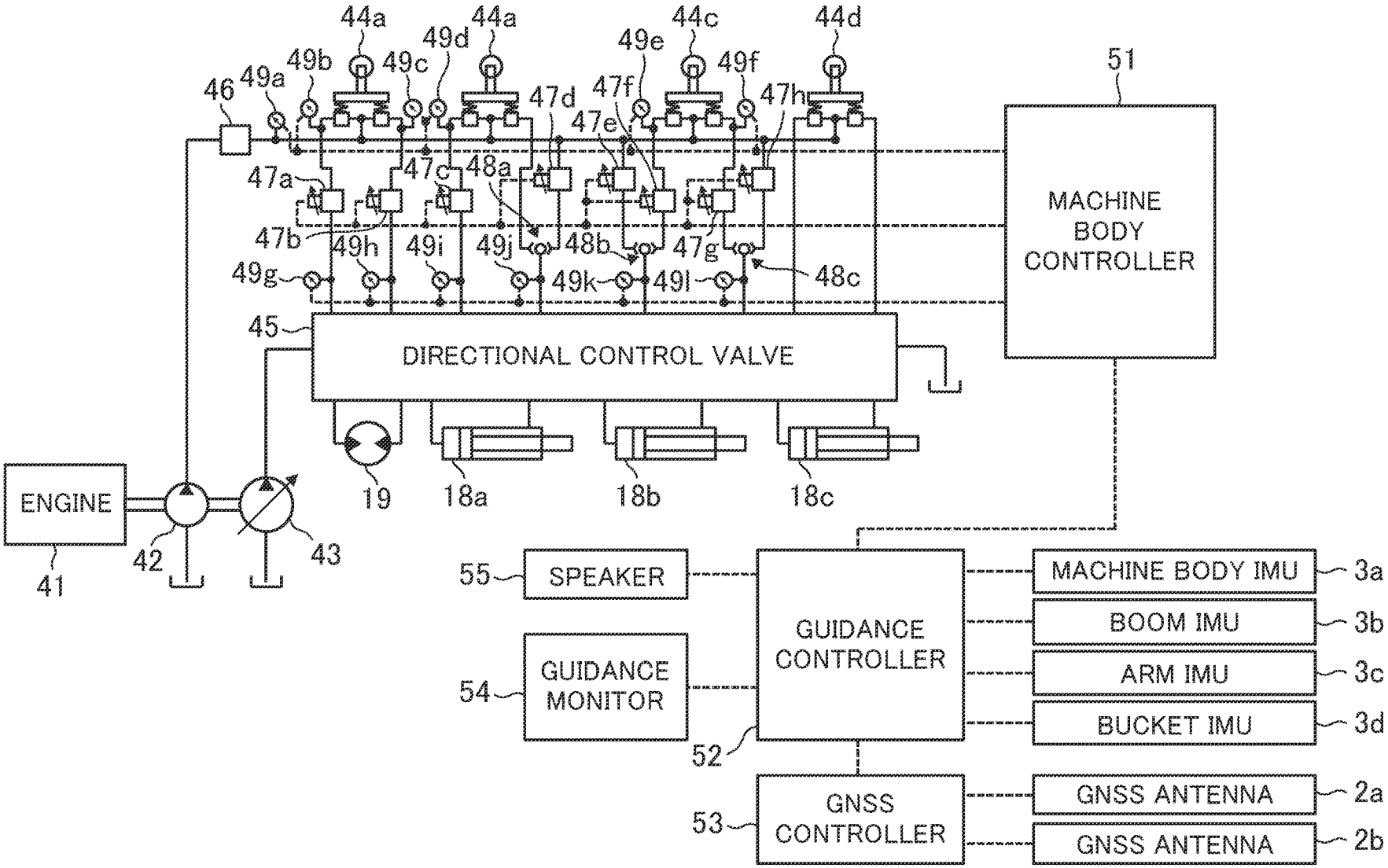
FIG. 2 is a configuration diagram of a hydraulic system of the hydraulic excavator according to Embodiment 1.

FIG. 2 is a configuration diagram of a hydraulic system of the hydraulic excavator according to Embodiment 1. The hydraulic excavator 1 is configured with an engine 41 and hydraulic pumps 42 and 43. The hydraulic pumps 42 and 43 are driven by the engine 41 and supply a pressurized fluid pumped up from a tank into a hydraulic circuit.

Furthermore, the hydraulic excavator 1 is configured with an operation device 44 formed from a plurality of operation levers 44*a* to 44*d*, a directional control valve 45 that controls a flow rate and a direction of a hydraulic operating fluid supplied to hydraulic actuators including the hydraulic cylinders 18 and the hydraulic motor 19 mounted in the hydraulic excavator 1, a plurality of control valves (solenoid valves) 47 that control a pressure of a pilot fluid acting on the directional control valve 45, a machine body controller 51 that exercises machine control over the hydraulic excavator 1 and that outputs control signals (command currents or command voltages) to the plurality of control valves 47, the guidance controller 52 that exercises control over a monitor for guidance (guidance monitor) 54 and a speaker (audio output device) 55 mounted in a cab seat of the hydraulic excavator 1 and that outputs position data about the work device 4, position data about a design surface 60, a state switching signal as a trigger of switchover control over the hydraulic cylinders 18, and the like to the machine body controller 51, and the GNSS controller 53 that computes the positions of the two GNSS antennas 2.

In FIG. 2, the operation device 44 includes the arm operation lever 44*a* for operating the arm 14 (arm cylinder 18*b*), the boom operation lever 44*b* for operating the boom 13 (boom cylinder 18*a*), the bucket operation lever 44*c* for operating the bucket 15 (bucket cylinder 18*c*), and the swing operation lever 44*d* for operating the upper swing structure 11 (swing hydraulic motor 19) (these are often collectively referred to as operation levers 44). The operation device 44 is arranged in such a manner that the pilot fluid is supplied to the operation levers 44 from the hydraulic pump 42, and the pilot fluid from the hydraulic pump 42 is decompressed as appropriate in response to lever operation amounts and flows to the directional control valve 45 upon operator's operating the operation levers 44. It is noted that two track operation levers operating left and right track hydraulic motors mounted in the lower track structure 12 are omitted in FIG. 2.

The directional control valve 45 controls a quantity and the direction of the hydraulic operating fluid supplied from the hydraulic pump 43 to the hydraulic cylinders 18 and the swing hydraulic motor 19, and it is determined how much hydraulic operating fluid flows in what direction to what actuator among the hydraulic cylinders 18 and the swing hydraulic motor 19 in response to the pilot fluid output from the operation levers 44. Owing to this, operating any of the operation levers 44 makes it possible to drive any of the hydraulic cylinders 18 and the swing hydraulic motor 19 in a desired direction by a desired quantity. In other words, an operator can operate the work device 4 via the operation device 44 to cause the work device 4 to take an optional posture, and conduct desired work as a result of the operation.

A shut-off valve 46 is provided in a hydraulic line connecting the hydraulic pump 42 to each of the operation levers 44. Upon closing the shut-off valve 46, supply of the pilot fluid from the hydraulic pump 42 to each of the operation levers 44 is stopped. As a result, the pilot fluid does not flow to the directional control valve 45 even by operating the operation levers 44, and it is possible to make a state in which the hydraulic cylinders 18 and the swing hydraulic motor 19 are not driven. The shut-off valve 46 may be configured to be physically driven to be opened or closed in response to a position of a lock lever (not depicted) operated by the operator when the operator gets in and out of the hydraulic excavator 1, or may be configured to be electrically driven to be opened or closed by a control signal output from the machine body controller 51.

Out of two hydraulic lines through which the pilot fluid is supplied from the arm operation lever 44*a* to the directional control valve 45, a control valve 47*a* is inserted into one of the hydraulic lines in which the pilot fluid flows at a time of an arm bending operation (arm crowding operation), and a control valve 47*b* is inserted into the other hydraulic line in which the pilot fluid flows at a time of an arm stretching operation (arm dumping operation). Out of two hydraulic lines through which the pilot fluid is supplied from the boom operation lever 44*b* to the directional control valve 45, a control valve 47*c* is inserted into one of the hydraulic lines in which the pilot fluid flows at a time of a boom lowering operation, and a shuttle valve 48*a* is inserted into the other hydraulic line in which the pilot fluid flows at a time of a boom raising operation. One of inlets of the shuttle valve 48*a* is connected to the hydraulic pump 42 via a control valve 47*d*. Out of two hydraulic lines through which the pilot fluid is supplied from the bucket operation lever 44*c* to the directional control valve 45, a control valve 47*f* and a shuttle valve 48*b* are connected in series to one of the hydraulic lines in which the pilot fluid flows at a time of a bucket crowding operation, and a control valve 47*g* and a shuttle valve 48*c* are connected in series to the other hydraulic line in which the pilot fluid flows at a time of a bucket dumping operation. One of inlets of the shuttle valve 48*b* is connected to the hydraulic pump 42 via a control valve 47*e*, and one of inlets of the shuttle valve 48*c* is connected to the hydraulic pump 42 via a control valve 47*h* (hereinafter, the eight control valves 47*a* to 47*h* are often collectively referred to as control valves 47 and the three shuttle valves 48*a* to 48*c* are often collectively referred to as shuttle valves 48). Each of the shuttle valves 48 has two inlets and one outlet, and a high-pressure side inlet out of the two inlets is connected to the outlet.

Each of the control valves 47 is a solenoid valve electrically connected to the machine body controller 51, an opening degree of each control valve 47 is controlled on the basis of a control signal (command voltage or command current) output from the machine body controller 51, and each control valve 47 generates a pilot pressure in response to the opening degree thereof. The generated pilot pressure is output to the directional control valve 45 at a time of semiautomatic control. Setting lower the opening degrees of the control valves 47*a*, 47*b*, 47*c*, 47*f*, and 47*g* makes it possible to reduce the flow rate of the pilot fluid from the operation levers 44. In other words, this means that the machine body controller 51 can reduce or reduce to zero an actual moving velocity of work device 4, compared with a velocity specified by operator's operation input to the operation levers 44. Since the remaining control valves 47*d*, 47*e*, and 47*f* are directly connected to the hydraulic pump 42 without via the operation levers 44, it is possible to feed the pilot fluid to the directional control valve 45 from the control valves 47*d*, 47*e*, and 47*f* by increasing the opening degrees of the control valves 47*d*, 47*e*, and 47*h*. In other words, this means that the machine body controller 51 can increase the actual moving velocity of the work device 4, compared with the velocity specified by the operator's operation input to the operation levers 44. Such a configuration enables the machine body controller 51 to increase and reduce (to zero) the actual velocity of the work device 4 in response to the operator's operation.

A plurality of hydraulic sensors (pressure sensors) 49 that detect pressures (pilot pressures) in front of and in rear of the shut-off valve 46 and the control valves 47 are provided downstream of the shut-off valve 46 and upstream and downstream of the control valves 47. A hydraulic sensor 49*a* is installed downstream of the shut-off valve 46 and used to confirm whether the shut-off valve 46 is correctly opened. Hydraulic sensors 49*b* and 49*c* are used to acquire an arm operation velocity, hydraulic sensors 49*d* and 49*j* are used to acquire a boom operation velocity, and hydraulic sensors 49*e* and 49*f* are used to acquire a bucket operation velocity. The hydraulic sensors 49*g* to 491 are used to acquire actual command velocities after control by the control valves 47. The pressures detected by the hydraulic sensors 49*b* to 491 are converted into command velocities using a conversion table prepared by performing calibration or the like in advance.

In manual control (first control) to control the actuators (hydraulic cylinders) 18*a*, 18*b*, and 18*c* on the basis of the operation input to the operation device 44, the machine body controller 51 sets maximum the opening degrees of the control valves 47*a*, 47*b*, 47*c*, 47*f*, and 47*g* (releases the control valves 47*a*, 47*b*, 47*c*, 47*f*, and 47*g*) and sets minimum the opening degrees of the control valves 47*d*, 47*e*, and 47*h* (shuts off the control valves 47*d*, 47*e*, and 47*h*), thereby making a state in which the pilot pressures from the operation levers 44 are fed to the directional control valve 45 as they are and in which the work device 4 can be operated in accordance with the operator's operation. On the other hand, in semiautomatic control (second control) to control the actuators (hydraulic cylinders) 18*a*, 18*b*, and 18*c* in accordance with a predetermined condition (distance d (to be described later) between the design surface 60 and a bucket tip end 150 in the present embodiment) either irrespectively of an operation during the operation of the operation device 44 or using part of the operation, the machine body controller 51 computes target velocities of the actuators 18*a*, 18*b*, and 18*c* that satisfy the predetermined condition, and sets the opening degrees of the control valves 47 in response to the computed target velocities, thereby making a state in which the work device 4 can be controlled in accordance with the predetermined condition. In other words, the machine body controller 51 can switch control over the actuators (hydraulic cylinders) 18*a*, 18*b* and 18*c* to any one of the two types of control, that is, the manual control and the semiautomatic control. The operator can transmit an instruction as to which of the two types of control is used to the machine body controller 51 via a selector switch 56 (depicted in FIG. 3) provided in a cabin on the upper swing structure 11. Furthermore, switchover between the two types of control is often performed on the basis of a state transition signal (to be described later) input to a state transition section 51*a* (depicted in FIG. 3) within the machine body controller 51.

Figure 3:
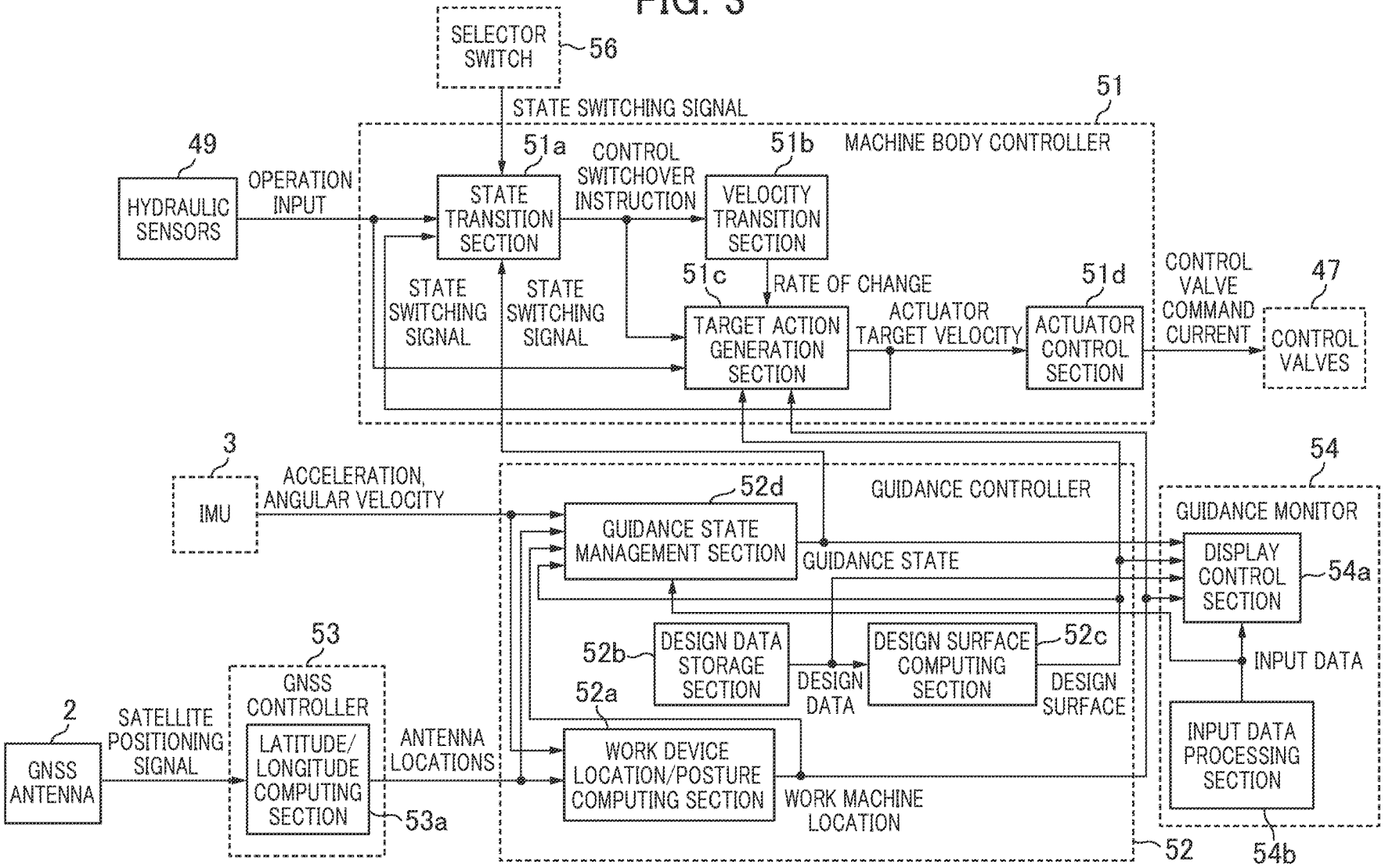
FIG. 3 is a functional block diagram of a machine body controller, a guidance controller, a GNSS controller, and a guidance monitor according to Embodiment 1.

Each of the machine body controller 51, the guidance controller 52, and the GNSS controller 53 is hardware corresponding to a computer that has a processing device (for example, CPU) and a storage device (for example, a semiconductor memory such as a ROM and a RAM) storing therein programs executed by the processing device, data necessary to execute the programs, and the like. FIG. 3 is a diagram depicting various types of computing processing executed by the machine body controller 51, the guidance controller 52, and the GNSS controller 53 as functional blocks. While the hydraulic excavator 1 is configured with the three controllers 51, 52, and 53 in conformity with the actual machine in the present embodiment, the three controllers 51, 52, and 53 may be integrated, for example, into one controller or functions may be further separated to configure a system capable of realizing similar functions using four or more controllers.

<GNSS Controller 53>

The GNSS controller 53 is a positioning controller for measuring the positions of the two antennas 2 from the signals received by the two antennas 2. It is noted that various kinds of antenna positioning methods are present and that the present invention is not intended to limit the antenna positioning method to a specific method. For example, a scheme such as an RTK-GNSS (Real Time Kinematic-GNSS) for receiving correction data from a reference station having a GNSS antenna installed on-site and acquiring self positions with higher precision may be used. In this case, while the hydraulic excavator 1 needs a receiver for receiving the correction data from the reference station, the self positions of the antennas 2 can be measured with higher precision.

As depicted in FIG. 3, the GNSS controller 53 is configured with a latitude/longitude computing section 53*a*. The GNSS controller 53 computes the positions (for example, latitudes, longitudes, and altitudes) of the GNSS antennas 2*a* and 2*b* on the earth on the basis of the signals transmitted from the plurality of GNSS satellites and input from the GNSS antennas 2*a* and 2*b*, and transmits a result of computing to the guidance controller 52.

<Guidance Controller 52>

As depicted in FIG. 3, the guidance controller 52 is configured with a work device position/posture computing section 52*a* that computes positions and postures of the front members 13, 14, and 15 of the work device 4 on the basis of output from the IMUs 3 and the GNSS controller 53, a design data storage section 52*b* that records therein three-dimensional design data indicating a target shape of an object to be worked by the hydraulic excavator 1, a design surface computing section 52*c* that computes two-dimensional design surface data (segment data about the design surface) from a line of intersection between the three-dimensional design data stored in the design data storage section 52*b* and the action plane of the work device 4, and a guidance state management section 52*d* that manages operating conditions of the IMUs 3 and the GNSS controller 53, whether or not the design surface 60 is present near the bucket tip end 150, and the like.

The guidance controller 52 stores data as to at which positions on the upper swing structure 11, the GNSS antennas 2 are disposed, and the work device position/posture computing section 52*a* can obtain a position of the upper swing structure 11 on the earth (position of the upper swing structure 11 on a geographic coordinate system) by back calculation from the positions of the GNSS antennas 2 input from the GNSS controller 53. The GNSS antennas 2 can thereby function as position sensors for sensing a position of the work device 4 and the position of the upper swing structure 11 to which the work device 4 is attached. Since the two GNSS antennas 2 are mounted in the hydraulic excavator 1 according to the present embodiment, it is also possible to grasp an azimuth of the upper swing structure 11 (in which directions, the boom 13, the arm 14, and the bucket 15 are oriented) from the positions of the two GNSS antennas 2. The position and the azimuth of the upper swing structure 11 on the geographic coordinate system computed by the GNSS controller 53 can be used by being converted into a position and an azimuth thereof on an optional coordinate system as appropriate.

Furthermore, the work device position/posture computing section 52*a* can compute self postures of the IMUs 3 on the basis of measurement data such as the acceleration and the angular velocity input from the IMUs 3. Owing to this, the work device position/posture computing section 52*a* can compute a longitudinal inclination and a lateral inclination of the upper swing structure 11 using the data from the machine body IMU 3*a*, compute a rotation posture of the boom 13 using the data from the boom IMU 3*b*, and compute a rotation posture of the arm 14 using the data from the arm IMU 3*c*. Moreover, the work device position/posture computing section 52*a* can grasp a rotation posture of the bucket link 16 using the data from the bucket IMU 3*d*, and compute a rotation posture of the bucket 15 by computing based on the rotation posture of the arm 14 and dimensional data about the four-joint link mechanism formed from the arm 14, the bucket links 16 and 17, and the bucket 15.

In this way, the work device position/posture computing section 52*a* can compute the position, the azimuth, the longitudinal inclination, and the lateral inclination of the upper swing structure 11 on the geographic coordinate system, and perform computing at which position on the earth in what posture the upper swing structure 11 is present. Furthermore, dimensional information about adjacent elements on the action plane of the work device 4 among rotation centers of the boom 13, the arm 14, and the bucket 15 and the bucket tip end (also referred to as bucket claw tip) 150 is stored in the storage device within the guidance controller 52. Owing to this, the work device position/posture computing section 52*a* can grasp a position of the bucket tip end 150 relative to the upper swing structure 11 (for example, a base end-side position of the rotation center of the boom 13) by combination with the data about the rotation postures of the front members 13, 14, and 15 acquired by the IMUs 3.

The work device position/posture computing section 52*a* can, therefore, obtain data about the positions, the postures, and the azimuths of the upper swing structure 11 and the front members 13, 14, and 15 of the work device 4 on the geographic coordinate system (including position data about the bucket tip end 150). These items of data are output to the guidance state management section 52*d* and the design surface computing section 52*c* within the guidance controller 52, a target action generation section 51*c* within the machine body controller 51, the guidance monitor 54, and the like.

The design surface computing section 52*c* computes a latest action plane of the work device 4 from the data about the positions, the postures, and the azimuths of the front members 13, 14, and 15 input from the work device position/posture computing section 52*a*, and computes the segment data about the design surface 60 used in the semiautomatic control from the line of intersection between the computed action plane and the three-dimensional design data stored in the design data storage section 52*b*. The design surface computing section 52*c* outputs the segment data about the design surface 60 to the guidance monitor 54, the target action generation section 51*c* within the machine body controller 51, and the like.

The guidance state management section 52*d* manages operating conditions of the IMUs 3 and the GNSS controller 53, whether or not the design surface 60 is present near the bucket tip end 150, and the like. The guidance state management section 52*d* monitors sensor output from the IMUs 3 and determines whether an abnormality occurs in each of the IMUs 3. In a case, for example, in which stop of the signals from any of the IMUs 3 is detected, the guidance state management section 52*d* determines occurrence of an abnormality in the IMU 3 due to a function stop, a breaking, or the like of the IMU 3. In a case of determining occurrence of an abnormality in the IMU 3, the guidance state management section 52*d* outputs a first state switching signal to the state transition section 51*a* within the machine body controller 51.

The "first state switching signal" is a signal for forcibly switching the semiautomatic control to the manual control because of a state in which an abnormality occurs in hardware and software necessary to control the hydraulic cylinders 18 by the semiautomatic control to make it impossible to execute the semiautomatic control. In other words, the "first state switching signal" is a switching signal for forcibly switching over to a semiautomatic control prohibition mode (manual control mode) in which execution of the semiautomatic control by the machine body controller 51 is prohibited and execution of only the manual control is permitted. State switching signals in the present embodiment further include a second state switching signal and a third switching signal. The "second state switching signal" is a signal for switching the semiautomatic control to the manual control at optional timing desired by the operator. In other words, the "second state switching signal" is a signal for optionally switching a semiautomatic control permission mode (semiautomatic control mode) in which the semiautomatic control is permitted to the semiautomatic control prohibition mode (manual control mode) in which the semiautomatic control is prohibited. The "third state switching signal" is a signal for switching the manual control to the semiautomatic control at optional timing desired by the operator. In other words, the third state switching signal is a signal for optionally switching the semiautomatic control prohibition mode (manual control mode) in which the semiautomatic control is prohibited to the semiautomatic control permission mode (semiautomatic control mode) in which the semiautomatic control is permitted.

Moreover, the guidance state management section 52*d* monitors positioning data about the antennas 2 input from the GNSS controller 53, and determines whether an abnormality occurs in positioning of each of the antennas 2. In a case, for example, in which stop of the signals from the GNSS controller 53 is detected, a case in which positioning precision input from the GNSS controller 53 falls to be lower than predetermined threshold, or a case in which data indicating that positioning of the antennas 2 is impossible is input from the GNSS controller 53, the guidance state management section 52*d* determines occurrence of an abnormality in positioning of the antennas 2 (GNSS). In a case of determining occurrence of an abnormality in the GNSS, the guidance state management section 52*d* outputs the first state switching signal to the state transition section 51*a* within the machine body controller 51. It is noted that the GNSS controller 53 may detect an abnormality in the GNSS, notify the guidance state management section 52*d* within the guidance controller 52 of the abnormality, or directly notify the state transition section 51*a* within the machine body controller 51 of the abnormality.

Figure 8:
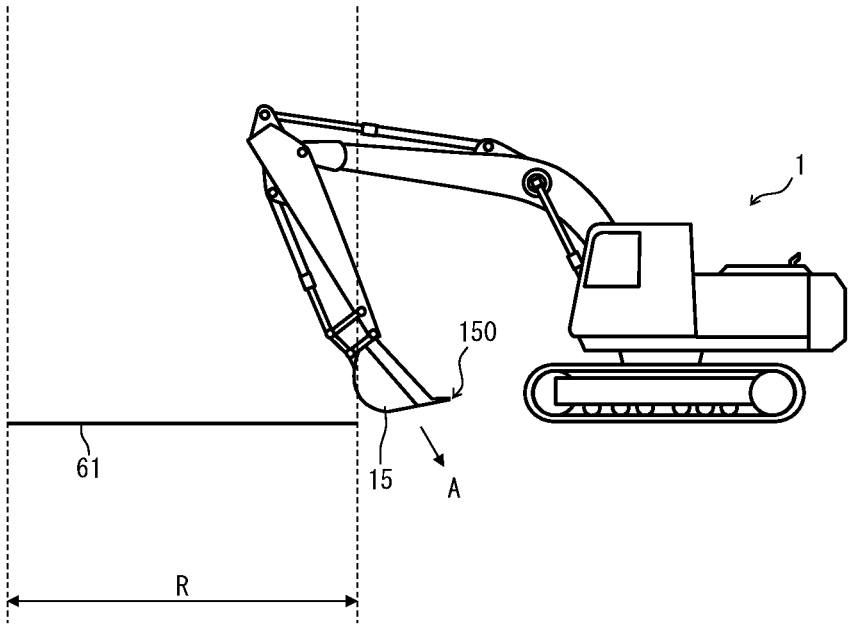
FIG. 8 is a diagram depicting the hydraulic excavator and design data according to Embodiment 1.

Furthermore, the guidance state management section 52*d* monitors the position data about the design surface 60 input from the design surface computing section 52*c* and the position data/posture data about the bucket 15 (including the position data about the bucket tip end 150) input from the work device position/posture computing section 52*a*, and determines whether the design surface 60 to be controlled in the semiautomatic control is present near the bucket 15. In a case, for example, in which an optional point on the bucket 15 is out of a region R where the design surface 60 is present (refer to FIG. 8, where a reference character of the design surface in FIG. 8 is 61) in a view of the region R from a vertical direction of the region R, the guidance state management section 52*d* can determine that the design surface 60 is not present near the bucket 15 (in other words, the bucket 15 is present outside of the region where the design surface 60 is present). In a case of determining that the design surface 60 is not present near the bucket 15, the guidance state management section 52*d* outputs the first state switching signal to the state transition section 51*a* within the machine body controller 51.

<Guidance Monitor/Speaker>

The guidance monitor 54 is a monitor on which a current posture of the work device 4, a shape of the design surface 60 (design data) near the bucket tip end 150, distance information (d) between the bucket tip end 150 and the design surface 60, and the like are displayed. In the present embodiment, the guidance monitor 54 is configured from a touch panel monitor having a function to receive an input operation from the operator, and incorporates therein hardware corresponding to a computer that has a processing device (for example, CPU) and a storage device (for example, semiconductor memory such as a ROM and a RAM) storing therein programs related to display and input executed by the processing device, data necessary to execute the programs, and the like. The guidance monitor 54 is configured with a display control section 54*a* that controls information to be displayed on the monitor and an input data processing section 54*b* that converts an operator's touch operation input to the monitor into input data.

The display control section 54*a* displays information such as the design data input from the guidance controller 52, the posture of the work device 4 in the hydraulic excavator 1, and a relative position relationship between the bucket tip end 150 and the design data on the guidance monitor 54. For example, displaying the segment data about the design surface 60 and a side surface image of the bucket 15 enables the operator to be notified of a latest position relationship between the bucket 15 and the design surface 60. The operator operates the work device 4 on the basis of these items of information obtained from the guidance monitor 54 in such a manner, for example, as to keep the distance d between the design data (design surface 60) and the bucket tip end 150 to zero, thereby making it possible to conduct excavation work to obtain the target shape agreeable to the design data.

Moreover, the guidance controller 52 can transmit the relative position relationship between the design surface 60 and the bucket tip end 150 to the operator using a speaker 55 by a change in a volume of an alarm, a sound interval, a tone, or the like. For example, as the bucket tip end 150 is closer to the design surface 60, the volume can be turned up, the sound interval can be set shorter, or a frequency can be set higher. The operator can thereby operate the work device 4 in such a manner as to set a distance, for example, between the target shape and the bucket tip end 150 to zero in accordance with the change in the alarm from the speaker 55, without paying attention to the guidance monitor 54.

The guidance controller 52 transmits data such as the design data (design surface 60), the posture of the work device 4, and the relative position relationship between the design surface 60 and the bucket tip end 150 to the machine body controller 51. The machine body controller 51 can control the work device 4 in the semiautomatic control (second control) on the basis of these items of data in such a manner, for example, that the distance d between the design surface 60 and the bucket tip end 150 is equal to zero, and perform the excavation work in such a manner as to have the target shape agreeable to the design data either without the operator's operation or by intervention in the operator's operation. Details of the semiautomatic control exercised by the machine body controller 51 will next be described.

<Machine Body Controller>

The machine body controller 51 controls the actuators (hydraulic cylinders) 18*a*, 18*b*, and 18*c* by either the manual control (first control) to control the actuators (hydraulic cylinders) 18*a*, 18*b*, and 18*c* on the basis of the operation input to the operation device 44 or the semiautomatic control (second control) to control the actuators (hydraulic cylinders) 18*a*, 18*b*, and 18*c* on the basis of the distance d between the design surface 60 and the work device 4 (bucket tip end 150) while the operation device 44 is being operated. To exert this function, the machine body controller 51 is configured with the state transition section 51*a* that switches over between the manual control (first control) and the semiautomatic control (second control) on the basis of input of the state switching signal (first, second, or third state switching signal), a velocity transition section 51*b* that sets a limiting value for a rate of change with time in velocities of the hydraulic cylinders (actuators) 18*a* to 18*c* at a time of switchover between the manual control and the semiautomatic control, the target action generation section 51*c* that computes target velocities of the hydraulic cylinders (actuators) 18*a* to 18*c*, and an actuator control section 51*d* that computes/outputs control commands to the control valves 47 in such a manner as to actuate the hydraulic cylinders (actuators) 18*a* to 18*c* at the target velocities.

The state transition section 51*a* switches a scheme of control over the hydraulic cylinders (actuators) 18*a* to 18*c* exercised by the target action generation section 51*c* to either the manual control (first control) or the semiautomatic control (second control) on the basis of the any of the state switching signals (first, second, and third state switching signal) input from the selector switch 56, the guidance state management section 52*d* within the guidance controller 52, and the target action generation section 51*c* within the machine body controller 51. The first state switching signal is input from the guidance state management section 52*d* within the guidance controller 52 and the target action generation section 51*c* within the machine body controller 51. The second and third state switching signals are input from the selector switch 56 installed in the cab of the hydraulic excavator 1.

The selector switch 56 is a two-position switchover type switch operated by the operator at optional timing, and has a first position at which the semiautomatic control prohibition mode (manual control mode) for prohibiting the semiautomatic control is selected and a second position at which the semiautomatic control permission mode (semiautomatic control mode) for permitting the semiautomatic control is selected. Upon switchover from the second position to the first position, the selector switch 56 outputs the second state switching signal to the state transition section 51*a*. On the other hand, upon switchover from the first position to the second position, the selector switch 56 outputs the third state switching signal to the state transition section 51*a*.

The state transition section 51*a* to which any of the first and second state switching signals is input switches the semiautomatic control (second control) to the manual control (first control) in a case in which the semiautomatic control (second control) is being executed when the state switching signal is input to the state transition section 51*a*, and prohibits subsequent execution of the semiautomatic control in a case in which the manual control (first control) is being executed when the state switching signal is input thereto. On the other hand, the state transition section 51*a* to which the third state switching signal is input switches the manual control (first control) to the semiautomatic control (second control) in a case in which a condition for executing the semiautomatic control is satisfied when the state switching signal is input to the state transition section 51*a*, and continues the manual control (first control) in a case in which the condition for executing the semiautomatic control is not satisfied when the state switching signal is input thereto.

The velocity transition section 51*b* sets a limiting value for a rate of change with time in each of the velocities (which is referred to as a "rate of velocity change") of the actuators to be controlled (hydraulic cylinders) 18*a*, 18*b*, and 18*c* to a first rate of change I1 when the state transition section 51*a* switches over between the two types of control, that is, the manual control and the semiautomatic control, and the velocities of the actuators (hydraulic cylinders) 18*a*, 18*b*, and 18*c* are changed from velocities specified by the control before switchover out of the two types of control to the velocities specified by the control after switchover. In addition, the velocity transition section 51*b* changes the rate of change with time in each of the velocities of the actuators (hydraulic cylinders) 18*a*, 18*b*, and 18*c* from the first rate of change I1 to a second rate of change I2 higher than the first rate of change I1 in a case in which the state transition section 51*a* switches over between the two types of control and the operation input to the operation device 44 changes while the velocities of the actuators (hydraulic cylinders) 18*a*, 18*b*, and 18*c* are changed to the velocities specified by the control after switchover. Changing the rate of change in each of the velocities at the time of switchover between the two types of control from the first rate of change I1 to the second rate of change I2 makes it possible to shorten time required for the switchover of the velocities between the two types of control, and shorten waiting time until the control after switchover of the velocities starts.

The target action generation section 51*c* is a section that computes target velocities of the hydraulic cylinders 18*a*, 18*b*, and 18*c* at the time of the manual control and target velocities of the hydraulic cylinders 18*a*, 18*b*, and 18*c* at the time of the semiautomatic control. The target action generation section 51*c* determines which control is used, the manual control or the semiautomatic control, on the basis of an instruction from the state transition section 51*a*.

<Target Action Generation Section 51*c* at Time of Semiautomatic Control>

At the time of the semiautomatic control, the target action generation section 51*c* computes the distance d between the design surface 60 and the work device 4 (bucket tip end 150) on the basis of the data input from the guidance controller 52. In addition, the target action generation section 51*c* computes the target velocities of the hydraulic cylinders 18*a*, 18*b*, and 18*c* in response to the distance d in such a manner that an action range of the work device 4 is limited onto and above the design surface 60 while the operation device 44 is operated. In the present embodiment, the target action computing section 51*c* executes the following computing.

First, the target action generation section 51*c* calculates a demanded velocity (boom cylinder demanded velocity) of the boom cylinder 18*a* from a voltage value (boom operation amount) input from the operation lever 44*b*, calculates a demanded velocity of the arm cylinder 18*b* from a voltage value (arm operation amount) input from the operation lever 44*c*, and calculates a demanded velocity of the bucket cylinder 18*c* from a voltage value (bucket operation amount) input from the operation lever 44*d*. The target action generation section 51*c* calculates a velocity vector (demanded velocity vector) V0 (refer to a left figure of FIG. 5) of the work device 4 on the bucket tip end 150 from the tree demanded velocities and the postures of the front members 13, 14, and 15 of the work device 4 computed by the work device position/posture computing section 52*a*. Furthermore, the target action generation section 51*c* also calculates a velocity component V0*z* of the velocity vector V0 in a design surface vertical direction and a velocity component V0*x* thereof in a design surface horizontal direction.

Figure 4:
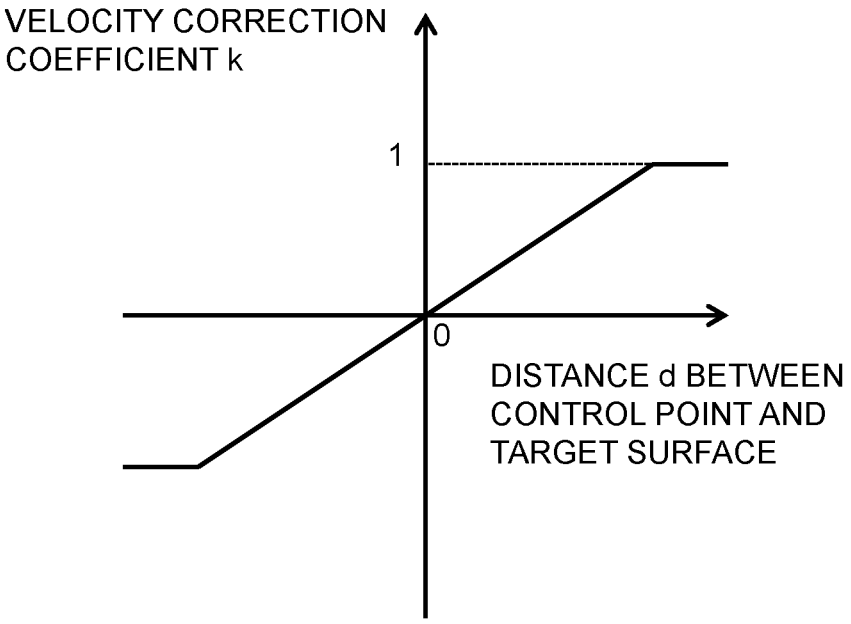
FIG. 4 is a relationship diagram between a distance d and a velocity correction coefficient k in semiautomatic control.

Next, the target action generation section 51*c* calculates a correction coefficient k determined in response to the distance d. FIG. 4 is a graph representing a relationship between the distance d between the bucket tip end 150 and the design surface 60 and the velocity correction coefficient k. It is assumed that the distance is positive when the bucket tip end 150 (control point of the work device 4) is located above the design surface 60 and the distance is negative when the bucket tip end 150 (control point of the work device 4) is located below the design surface 60, and the target action generation section 51*c* outputs a positive correction coefficient when the distance d is positive, and outputs a negative correction coefficient as a value equal to or smaller than 1 when the distance d is negative. It is noted that the velocity vector is assumed as being positive in a direction in which the bucket tip end 150 (control point of the work device 4) is closer to the design surface 60 from above the design surface 60.

Next, the target action generation section 51*c* calculates a velocity component V1*z* (refer to a right figure of FIG. 5) by multiplying the velocity component V0*z* of the velocity vector V0 in the design surface vertical direction by the correction coefficient k determined in response to the distance d. The target action generation section 51*c* calculates a resultant velocity vector (target velocity vector) V1 by combining the velocity component V1*z* with the velocity component V0*x* of the velocity vector V0 in the design surface horizontal direction, and computes a boom cylinder velocity, an arm cylinder velocity (Val), a bucket cylinder velocity at which the resultant velocity vector V1 can be generated, as the target velocity. At a time of computing the target velocities, the target action computing section 51*c* may use the postures of the front members 13, 14, and 15 of the work device 4 computed by the work device position/posture computing section 52*a*. The target action generation section 51*c* outputs the calculated target velocities of the hydraulic cylinders to the actuator control section 51*d*.

Figure 5:
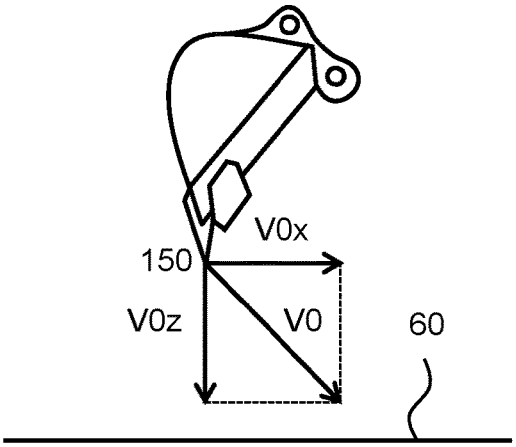
FIG. 5 is a schematic diagram representing velocity vectors of a bucket tip end before and after correction in response to the distance d.
Figure 5:
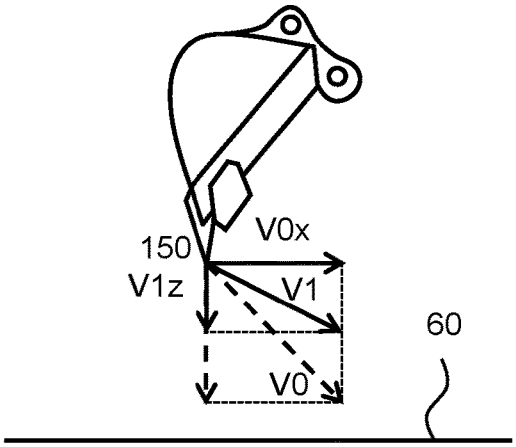

FIG. 5 are schematic diagrams representing velocity vectors on the bucket tip end 150 before and after correction in response to the distance d. The target action generation section 51*c* obtains the velocity vector V1*z* (refer to the right figure of FIG. 5) equal to or smaller than V0*z* in the design surface vertical direction by multiplying the component V0*z* (refer to the left figure of FIG. 5) of the demanded velocity vector V0 in the design surface vertical direction by the velocity correction coefficient k. The target action generation section 51*c* computes the resultant velocity vector V1 that is a combination of V1*z* with the component V0*x* of the demanded velocity vector V0 in the design surface horizontal direction, and calculates the arm cylinder target velocity, the boom cylinder target velocity, and the bucket cylinder target velocity at which the resultant velocity vector V1 can be output.

<Target Action Generation Section 51*c* at Time of Manual Control>

At the time of the manual control, the target action generation section 51*c* calculates first the target velocity of the boom cylinder 18*a* (same as the boom cylinder demanded velocity at the time of the semiautomatic control) from the voltage value (boom operation amount) input from the operation lever 44*b*, calculates the target velocity of the arm cylinder 18*b* (same as the arm cylinder demanded velocity at the time of the semiautomatic control) from the voltage value (arm operation amount) input from the operation lever 44*c*, and calculates the target velocity of the bucket cylinder 18*c* (same as the bucket cylinder demanded velocity at the time of the semiautomatic control) from the voltage value (bucket operation amount) input from the operation lever 44*d*. The target action generation section 51*c* outputs the calculated target velocities of the hydraulic cylinders to the actuator control section 51*d*.

<Target Action Generation Section 51*c* at Time of Detection of Abnormality>

Furthermore, the target action generation section 51*c* manages whether an abnormality occurs in hardware necessary for the semiautomatic control including the plurality of hydraulic sensors (pressure sensors) 49 disposed in front of and/or in rear of the shut-off valve 46 and the control valves 47 and detecting the pressures (pilot pressures) in front of and/or in rear of the shut-off valve 46 and the control valves 47, the shut-off valve 46, and the plurality of control valves 47. The target action generation section 51*c* determines whether an abnormality occurs in any of the shut-off valve 46, the control valves 47, and the hydraulic sensors 49 by comparing a value of a pilot pressure (target value) specified by the control signal (for example, command signal) output from the machine body controller 51 (for example, actuator control section 51*d*) to each of the shut-off valve 46 and the control valves 47 with a value of the pilot pressure (actual value) detected by each of the hydraulic sensors 49. For example, in a case in which the machine body controller 51 outputs the command current specifying that a fixed pressure is output downstream of each of the control valves 47 in a state in which a detected pressure value upstream of each of the control valves 47 detected by each of the hydraulic sensors 49 is sufficiently high, the target action generation section 51*c* can estimate that an abnormality occurs in any of the control valves 47 and the hydraulic sensors 49 (any of the control valves 47 and the hydraulic sensors 49 is abnormal) when the detected pressure value downstream of any of the control valves 47 detected by the corresponding hydraulic sensor 49 is clearly higher or lower than the command value. It is noted that the target action generation section 51*c* may determine whether an abnormality occurs in any of the control valves 47 and the hydraulic sensors 49 by comparing an actuator target velocity computed by itself (target action generation section 51*c*) with the value of the pilot pressure (actual value) detected by the corresponding hydraulic sensor 49. In this way, in a case of comparing the pressure value specified by the control signal generated by the machine body controller 51 with the detected value by each of the hydraulic sensors 49 while the actuators (hydraulic cylinders) 18*a*, 18*b*, and 18*c* are controlled by the semiautomatic control and determining occurrence of an abnormality in any of the shut-off valve 46, the control valves 47, and the hydraulic sensors 49, the target action generation section 51*c* outputs the first state switching signal for switching from the semiautomatic control (second control) to the manual control (first control) to the state transition section 51*a*.

The actuator control section 51*d* is a section that controls the directional control valve 45 by computing the control signals (control valve command currents) to the control valves 47 on the basis of the target velocities of the hydraulic cylinders 18*a*, 18*b*, and 18*c* computed by the target action generation section 51*c*, and outputting the control signals to the corresponding control valves 47. The directional control valve 45 controlled in this way causes the hydraulic cylinders 18*a*, 18*b*, and 18*c* to be actuated in accordance with the target velocities computed by the target action generation section 51*c*.

Figure 6:
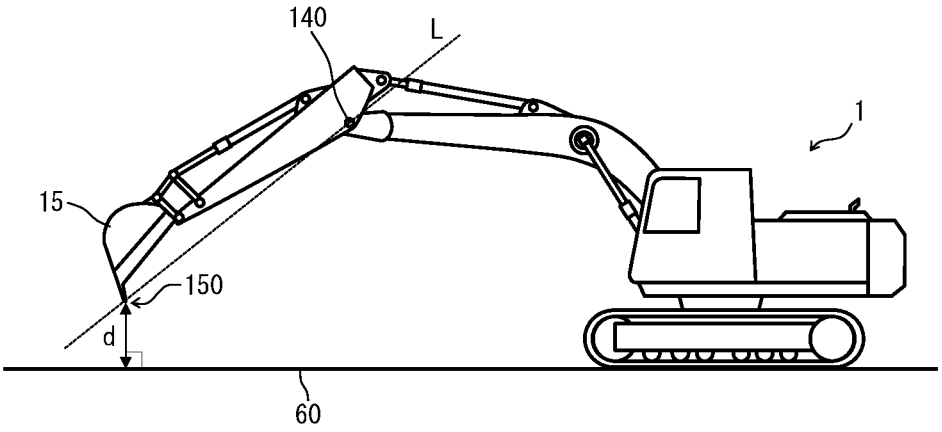
FIG. 6 is a diagram depicting the hydraulic excavator and design data according to Embodiment 1.

FIG. 6 is a diagram depicting a relationship between the hydraulic excavator 1 and the design surface (design data) 60. Types of the design surface 60 indicating the target shape of an object to be worked include single plane surface data formed from one surface and multiple surface data that includes a combination of a plurality of surfaces. In FIG. 6 it is assumed that the plane surface 60 is recorded as the design surface in the guidance controller 52, and an example of controlling the work device 4 using the plane surface 60 as the target shape will be described hereinafter.

<Excavation of Design Surface by Manual Control>

To conduct the excavation work for achieving the target shape by the hydraulic excavator 1 under the manual control (first control), it is necessary to appropriately actuate the work device 4 formed from the boom 13, the arm 14, and the bucket 15 and to actuate the work device 4 in such a manner that the bucket tip end 150 is actuated along the target shape. In other words, by causing the bucket 15 to be actuated in such a manner that the distance d between the plane surface 60 and the bucket tip end 150 is always equal to zero, a locus of the bucket tip end 150, that is, an excavation finished surface coincides with the plane surface 60. The hydraulic excavator 1 according to the present embodiment is configured with the guidance monitor 54, and posture data about the current work device 4, information about the target shape, the relative position relationship between the target shape and the bucket tip end 150 (data about the distance d), and the like are displayed on the guidance monitor 54. Owing to this, in the manual control, operator's referring to these items of information as appropriate makes it possible to conduct the excavation work for achieving the target shape by adjusting the distance d to be close to zero as much as possible by boom raising/lowering operations while performing an action to attract the bucket 15 toward the machine body by the arm bending operation (arm crowding operation).

<Excavation of Design Surface by Semiautomatic Control>

On the other hand, in the semiautomatic control (second control), the operator does not need to adjust the distance d by the boom raising/lowering operations while performing the arm bending operation similarly to the manual control, and a moving velocity of the boom 13 is controlled by the machine body controller 51. When the operator performs the arm bending operation in the posture of the work device 4 of the hydraulic excavator 1 as depicted in FIG. 6, the arm 14 is driven about a joint 140 that rotatably supports the boom 13 and the arm 14 in a direction closer to the plane surface 60 and the bucket 15 is also closer to the plane surface 60 as a result of driving of the arm 14, so that the distance d is closer to zero. When the arm 14 is continuously driven, then the bucket tip end 150 passes through the plane surface 60 and the distance d increases.

If the boom 13 (boom cylinder 18*a*) is driven herein at an appropriate velocity in response to the distance d, the excavation work can be conducted while the distance d is kept closer to zero. In the present embodiment, the machine body controller 51 computes the target velocity of the boom cylinder 18*a* in such a manner that the distance d is kept closer to zero on the basis of data such as the current posture of the work device 4, the moving velocity of the arm 14, and the relative position relationship between the design surface 60 and the work device 4 including the design surface 60 and the distance d obtained from the guidance controller 52, and drives the boom cylinder 18*a* agreeably to the target velocity computed by controlling the opening degrees of the control valves 47*c* and 47*d*.

Figure 7:
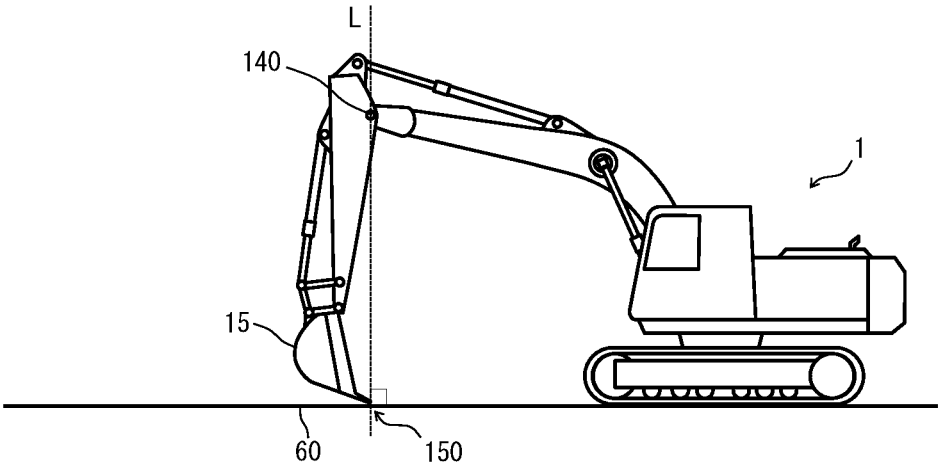
FIG. 7 is a diagram depicting an orthogonal posture of the hydraulic excavator according to Embodiment 1.

It is assumed herein that a posture of the work device 4 when a straight line L connecting the bucket tip end 150 to the joint 140 is orthogonal to the plane surface 60, as depicted in FIG. 7, is an orthogonal posture. Making a boom raising action just before the orthogonal posture and a boom lowering action just after the orthogonal posture while the arm bending operation is performed in a series of excavation work enables the bucket tip end 150 to be actuated along the plane surface 60.

It is possible to execute the boom raising action by causing the machine body controller 51 to increase the opening degree of the control valve 47*d*.

However, it is impossible to execute the boom lowering action only by causing the machine body controller 51 to adjust the opening degree of the control valve 47*c*. This is because the operation lever 44*b* is present between the control valve 47*c* and the hydraulic pump 42, and the pilot fluid does not flow to the control valve 47*c* unless the operation lever 44*b* is operated in a boom lowering direction. Owing to this, to control the boom lowering action, it is required for the operator to input an operation in the boom lowering direction to the operation lever 44*b*. After the pilot fluid is supplied from the operation lever 44*b* to the control valve 47*c*, it is possible to control the moving velocity of the boom 13 in the boom lowering direction by causing the machine body controller 51 to adjust the opening degree of the control valve 47*c*.

With such a configuration, it is conceivable as an operator's operation that the operator operates the operation lever 44*b* to achieve a maximum input operation in the boom lowering direction, while the operator inputs an operation to operate the operation levers 44*a* in the arm bending direction. In this case, the boom raising action is made by causing the machine body controller 51 to set the opening degree of the control valve 47*c* minimum (shut off the control valve 47*c*) and appropriately set the opening degree of the control valve 47*d* high until the orthogonal posture. Furthermore, the boom lowering action is made by causing the machine body controller 51 to set the opening degree of the control valve 47*d* minimum (shut off the control valve 47*d*) and set the opening degree of the control valve 47*c* high after the orthogonal posture. Thus, the excavation work for achieving the target shape can be conducted. Moreover, the operator does not need to adjust a boom operation but may simply continue to input the maximum operation (tilt the operation lever 44*b* to the maximum in the boom lowering direction).

FIG. 8 is a diagram depicting the relationship between the hydraulic excavator and a design surface 61 similarly to FIG. 6. In FIG. 8, it is assumed that the plane surface 61 is recorded as the design surface indicating the target shape in the guidance controller 52. The plane surface 61 is a single plane surface present only in the range R.

In the semiautomatic control, the machine body controller 51 computes the target velocity of the boom cylinder 18*a* on the basis of data such as the distance d as described above, and controls an action of the boom 13. It is to be noted, however, that in a case in which the bucket 15 or the bucket tip end 150 is out of the range where the design surface 61 is present, that is, out of the range R where the plane surface 61 is present as depicted in FIG. 8, then the machine body controller 51 turns into a situation in which the machine body controller 51 is incapable of obtaining the distance d and the like (relative position relationship between the target shape and the work device 4) and incapable of executing the semiautomatic control. In a case of such a situation in which the machine body controller 51 is incapable of continuing control in the semiautomatic control, it is necessary to forcibly switch the semiautomatic control to the manual control and to leave to an operator's operation. At this time, if the operator performs the maximum input operation on the operation lever 44*b* in the boom lowering direction under these circumstances, then the boom lowering action suddenly accelerates at a moment of switchover from the semiautomatic control to the manual control, the work device is suddenly actuated in a direction of an arrow A of FIG. 8, and the machine body possibly turns into an unstable condition. To suppress the problem, the machine body controller 51 limits the rate of velocity change of the boom cylinder 18*a* and prevents occurrence of sudden acceleration. It is to be noted, however, that in a case in which the operator's operation input to the operation lever changes at a rate equal to or greater than a threshold, the operator's feeling of strangeness due to a difference between the operator's operation and the actual action of the work device 4 is suppressed by relaxing or cancelling the limitation on the rate of velocity change.

Next, velocity transition control exercised at a time of transition from the semiautomatic control to the manual control and the manual control will be described using flowcharts. For brevity of description, it is assumed herein that only the boom cylinder 18*a* (that is, the boom 13) is controlled in the semiautomatic control.

Figure 9:
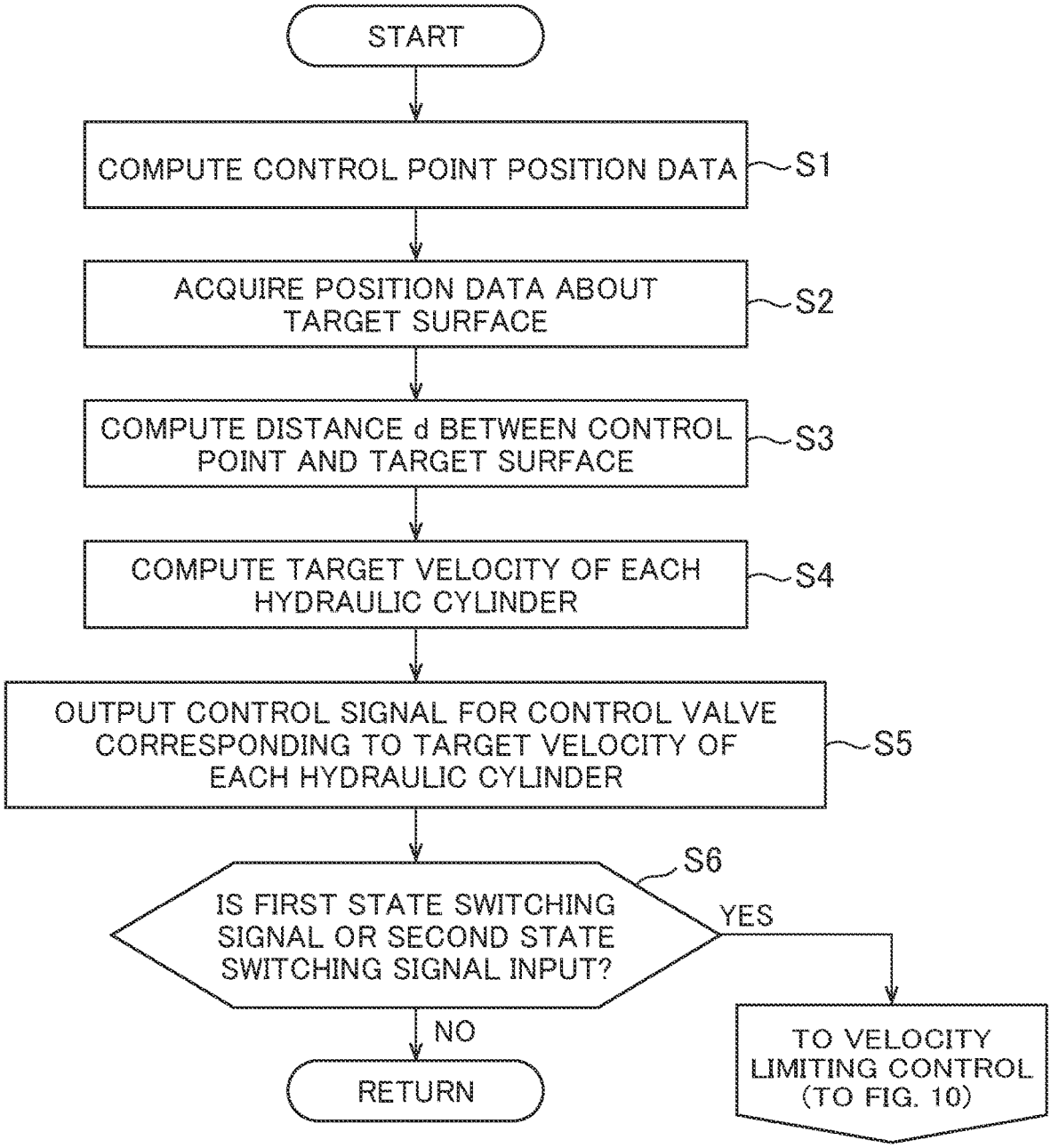
FIG. 9 is a flowchart illustrating a flow of semiautomatic control over the hydraulic excavator according to Embodiment 1.

FIG. 9 is a flowchart illustrating a flow of processing by the machine body controller 51 and the guidance controller 52 at the time of the semiautomatic control. Upon operator's operating the operation device 44, the machine body controller 51 and the guidance controller 52 start processing of FIG. 9. First, the work device position/posture computing section 52*a* within the guidance controller 52 computes position data about the bucket tip end 150 (control point) on the geographic coordinate system on the basis of the position data, the posture data (angle data), and the azimuth data about the hydraulic excavator 1, which are computed by the GNSS controller 53 on the basis of the data about the inclination angles of the front members 13, 14, and 15 and the upper swing structure 11 from the IMUs 3 and navigation signals from the GNSS antennas 2, the dimensional data about the front members 13, 14, and 15 stored in advance, and the like (Procedure S1).

In Procedure S2, the design surface computing section 52*c* within the guidance controller 52 acquires position data (design data) about the design surface 60 falling in a predetermined range with reference to the position data about the bucket tip end 150 on the geographic coordinate system computed by the work device position/posture computing section 52*a* (or using the position data about the hydraulic excavator 1) from the design data storage section 52*b*, and outputs the acquired position data (design data) to the target action generation section 51*c* within the machine body controller 51. The target action generation section 51*c* sets a design surface present at a position closest to the bucket tip end 150 among the design data as the design surface 60 to be controlled, that is, the design surface 60 for computing the distance d.

In Procedure S3, the target action generation section 51*c* computes the distance d on the basis of the position data about the bucket tip end 150 acquired in Procedure S1 and the position data about the design surface 60 acquired in Procedure S2.

In Procedure S4, the target action generation section 51*c* computes the target velocities of the hydraulic cylinders 18*a*, 18*b*, and 18*c* in such a manner that the bucket tip end 150 can be kept onto or above the design surface 60 even if the work device 4 is actuated on the basis of the distance d computed in Procedure S3 and the operation amount (pressure value) of each operation lever input from the operation device 44.

In Procedure S5, the actuator control section 51*d* computes the control signal (for example, command current) for driving each control valve 47 on the basis of the target velocity of each hydraulic cylinder, and outputs the computed control signal to the control valve 47 corresponding to the control signal. The hydraulic cylinders 18*a*, 18*b*, and 18*c* are thereby driven on the basis of the target velocities (actuator target operating velocities) of the hydraulic cylinders 18*a*, 18*b*, and 18*c*, and the front members 13, 14, and 15 are actuated.

Figure 10:
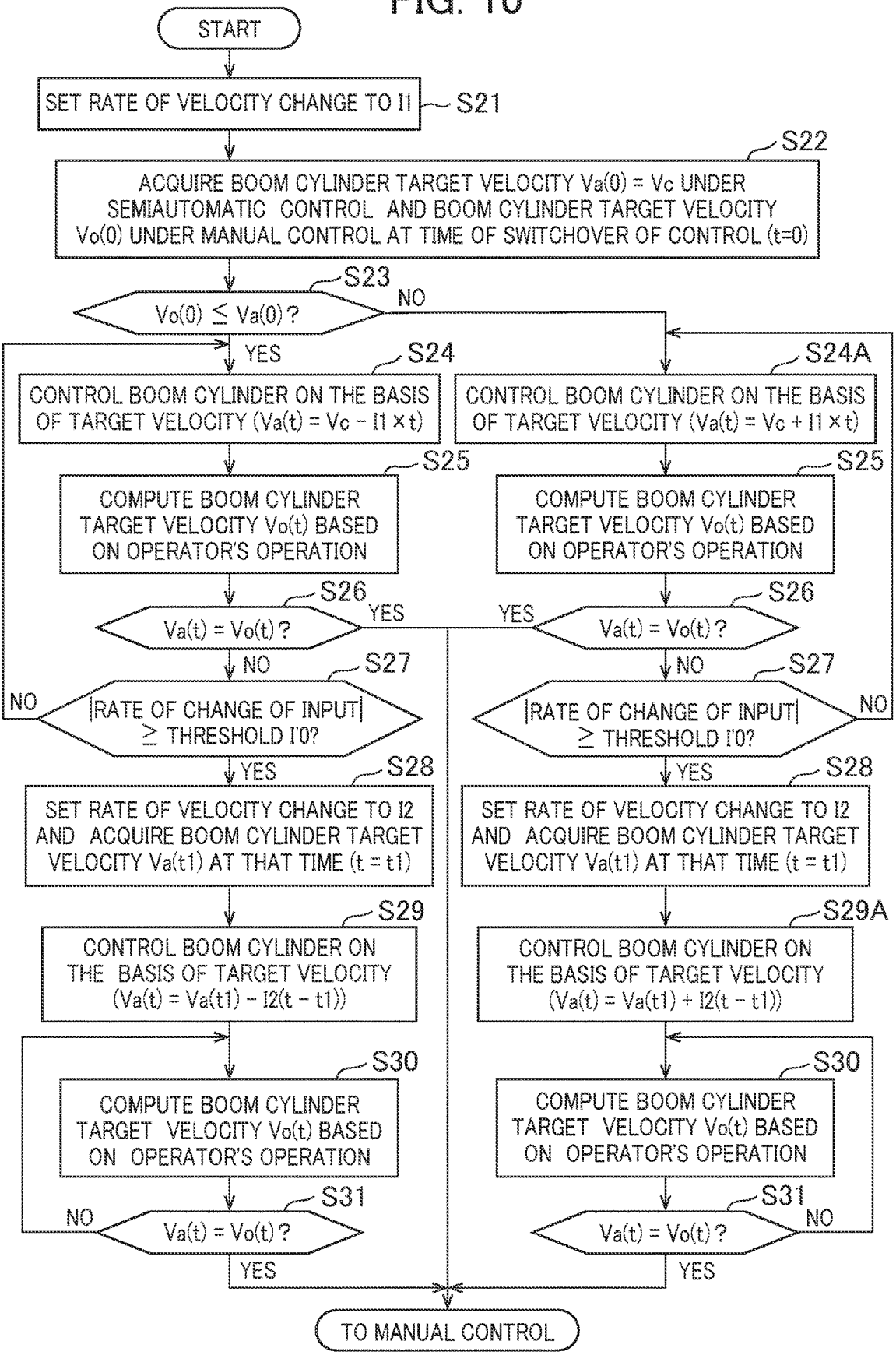
FIG. 10 is a flowchart illustrating a flow of velocity transition control over the hydraulic excavator according to Embodiment 1.

In Procedure S6, the target action generation section 51*c* determines whether a control switchover instruction (which is output in a case in which the first state switching signal or the second state switching signal is input to the state transition section 51*a*) for switching the semiautomatic control to the manual control is input from the state transition section 51*a*. In a case in which the control switchover instruction is input, the velocity transition control to be described next with reference to FIG. 10 is executed. On the other hand, in a case in which the control switchover instruction is not input, the processing returns to first Procedure S1, and the semiautomatic control is continued.

FIG. 10 is a flowchart illustrating a flow of processing (velocity transition control) by the machine body controller 51 at the time of switchover from the semiautomatic control to the manual control. It is assumed herein that elapsed time from a clock time (t0) of switchover of control is t (that is, the time t at the clock time t0 is 0). It is also assumed that a boom cylinder target velocity under the semiautomatic control at the clock time t is Va(t), and a boom cylinder target velocity under the manual control at the clock time t is Vo(t). The target velocities Va(t) and Vo(t) are a function of the time t. In FIG. 10, procedures of executing processing identical in a content are denoted by the same reference character.

In Procedure S21, upon input of the instruction to switch the semiautomatic control to the manual control (control switchover instruction) from the state transition section 51*a*, the velocity transition section 51*b* within the machine body controller 51 sets the rate of velocity change of each of the hydraulic cylinders 18*a*, 18*b*, and 18*c* used in the target action generation section 51*c* to the first rate of change I1.

In Procedure S22, the target action generation section 51*c* acquires a boom cylinder target velocity Va(0) under the semiautomatic control at the time of switchover (t=0) and a boom cylinder target velocity Vo(0) under the manual control at the time of switchover (t=0). Va(0) is a value computed in Procedure S4 of FIG. 9, Vo(0) is the same as a value computed in Procedure S21 of FIG. 11 to be described later, and both of Va(0) and Vo(0) are constants. The boom cylinder target velocity Va(0) under the semiautomatic control is, therefore, often represented as Va(0)=Vc.

In Procedure S23, the target action generation section 51*c* compares Va(0) with Vo(0) to determine magnitudes of Va(0) and Vo(0). Furthermore, in a case in which Vo(0)≤Va(0) is satisfied (that is, Va(0) is equal to or higher than Vo(0)), processing goes to Procedure S24; otherwise (that is, Va(0) is lower than Vo(0)), the processing goes to Procedure S24A.

In Procedure S24, the target action generation section 51*c* computes a value obtained by subtracting the first rate of velocity change I1 (rate of change in velocity) multiplied by t from Vc as a target velocity (Va(t)=Vc−I1×t) of the boom cylinder 18*a*, and controls the boom cylinder 18*a* by controlling the control valve 47 on the basis of the target velocity.

In Procedure S24A, the target action generation section 51*c* computes a value obtained by adding the first rate of velocity change I1 (rate of change in velocity) multiplied by t to Vc as a target velocity (Va(t)=Vc+I1×t) of the boom cylinder 18*a*, and controls the boom cylinder 18*a* by controlling the control valve 47 on the basis of the target velocity.

In Procedure S25, the target action generation section 51*c* computes the boom cylinder target velocity Vo(t) under the manual control at the clock time t on the basis of an operator's operation amount input to the operation device 44. The state transition section 51*b* may perform computing in this Procedure.

In Procedure S26, the target action generation section 51*c* determines whether Va(t) computed in Procedure S24 or Procedure S24A is equal to Vo(t) computed in Procedure S25. In a case in which Va(t) is not equal to Vo(t), the target action generation section 51*c* determines a state in which the velocity transition control is still necessary, and the processing goes to Procedure S27. On the other hand, in a case in which Va(t) is equal to Vo(t), the target action generation section 51*c* determines a state in which the velocity of the boom cylinder 18*a* does not change even if the semiautomatic control is switched to the manual control and in which the operator does not have a feeling of strangeness; thus, the processing goes to ordinary manual control depicted in FIG. 11.

In Procedure S27, the state transition section 51*a* determines whether an absolute value of an amount of change (rate of change) per time of the operation amount input by the operator to the operation device 44 (operation lever 44*b* in this example) of the hydraulic cylinder (boom cylinder 18*a* in this example) to be subjected to the semiautomatic control is equal to or greater than a threshold I'0 on the basis of the pilot pressure detected by the hydraulic cylinder 49 (operation input to the operation device 44). In a case in which an absolute value of the rate of change of the operation input is smaller than the threshold I'0, the processing goes to Procedure S24 and the rate of velocity change I1 is kept. On the other hand, in a case in which an absolute value of the rate of change of the operation input is equal to or greater than the threshold I'0, the processing goes to Procedure S28.

As a method of setting the threshold I'0, there is a method including, for example, recording the operator's boom operation input during ordinary work for a certain period of time, obtaining an amount of change of the operation input per time, and setting a value near or greater than a maximum value of the amount of change in the certain period of time. This method is based on the fact that a case of presence of an operation that is hardly input during the ordinary work can be considered as a situation of high urgency and determined as an instance, such as an instance that the boom 13 is to be quickly stopped, in which it is necessary to set greater a limiting value for the rate of change.

Furthermore, the threshold I'0 can be set to a value greater than a value I'1 that is a rate of change of the operation amount into which the rate of velocity change I1 is converted. According to the present invention, an operator's intention to change the velocity more quickly in a state of imposing limitations on the rate of change is read from the operation input and the rate of velocity change is changed to the greater value I2, and it is considered that a change in the operator's operation input greater than the rate of velocity change I1 is one of conditions for the intention.

While it is determined whether the rate of change of the operation input to the operation lever 44*b* is equal to or greater than the threshold I'0 in the present embodiment, it may be alternatively determined whether an absolute value of the amount of change per time of the boom cylinder target velocity Vo(t) under the manual control at the clock time t is equal to or greater than a threshold I0. It is to be noted, however, that the velocity threshold I0 in this case is assumed as a value equivalent to I'0 and determined by a concept similar to that of the threshold I'0 of the operation amount described above. It is noted that FIG. 12, to be described later, illustrates advantages of the present application using the velocity threshold I0.

In Procedure S28, the velocity transition section 51*b* changes the rate of velocity change of the hydraulic cylinder subjected to the semiautomatic control (boom cylinder 18*a* in this example) to a second rate of change I2 greater than the first rate of change I1. Furthermore, the target action generation section 51*c* acquires a boom cylinder target velocity Va(t1) under the semiautomatic control at a time (t=t1) of changing the rate of velocity change. Upon completion of the processing described so far, the processing goes to Procedure S29 or S29A.

In Procedure S29, the target action generation section 51*c* computes a value obtained by subtracting the second rate of velocity change I1 multiplied by (t−t1) from Va(t1) as a target velocity (Va(t)=Va(t1)−I2 (t−t1)) of the boom cylinder 18*a*, and controls the boom cylinder 18*a* by controlling the control valve 47 on the basis of the target velocity. The velocity limitation is thereby relaxed, thus the velocity of the boom cylinder 18*a* increases and time of transition to the manual control can be shortened.

In Procedure S29A, the target action generation section 51*c* computes a value obtained by adding the second rate of velocity change I1 multiplied by (t−t1) to Va(t1) as a target velocity (Va(t)=Va(t1)+I2 (t−t1)) of the boom cylinder 18*a*, and controls the boom cylinder 18*a* by controlling the control valve 47 on the basis of the target velocity. The velocity limitation is thereby relaxed, thus the velocity of the boom cylinder 18*a* increases and time of transition to the manual control can be shortened.

In Procedure S30, the target action generation section 51*c* computes the boom cylinder target velocity Vo(t) under the manual control at the clock time t on the basis of the operator's operation amount input to the operation device 44. The state transition section 51*b* may perform computing in this Procedure.

In Procedure S31, the target action generation section 51*c* determines whether Va(t) computed in Procedure S29 or S29A is equal to Vo(t) computed in Procedure S30. In a case in which Va(t) is not equal to Vo(t), the target action generation section 51*c* determines a state in which the velocity transition control is still necessary, and the processing returns to Procedure S29. On the other hand, in a case in which Va(t) is equal to Vo(t), the target action generation section 51*c* determines a state in which the velocity of the boom cylinder 18*a* does not change even if the semiautomatic control is switched to the manual control and in which the operator does not have a feeling of strangeness; thus, the processing goes to ordinary manual control depicted in FIG. 11.

Figure 11:
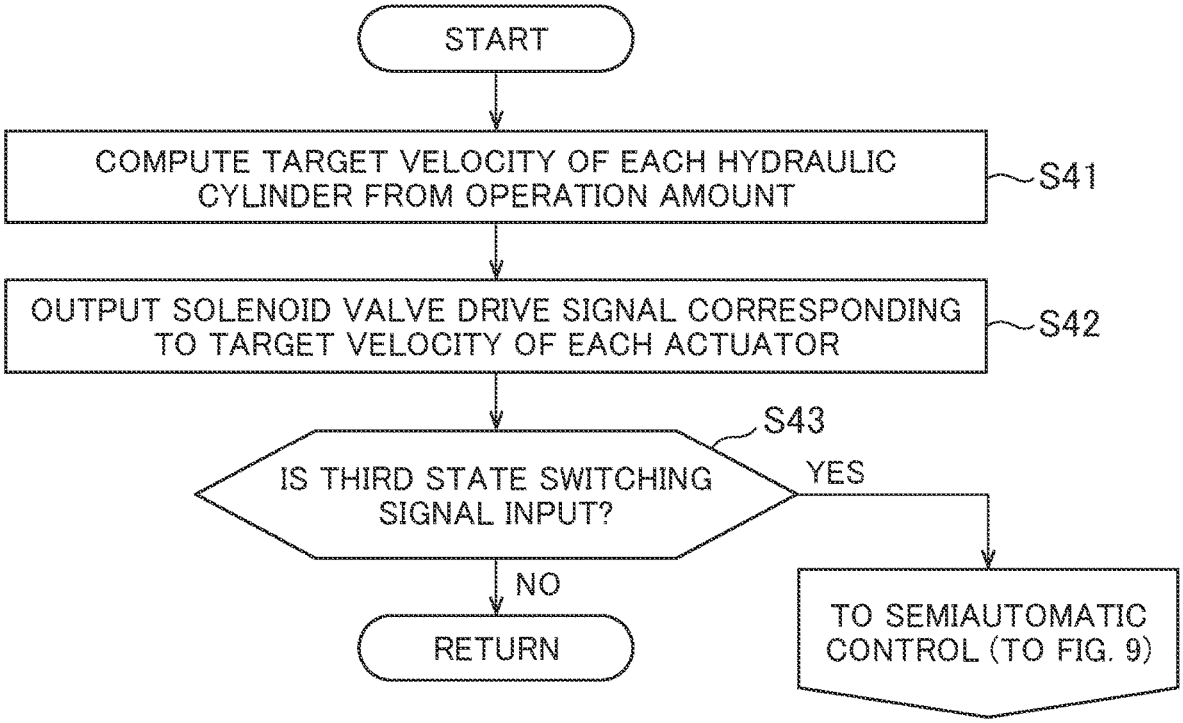
FIG. 11 is a flowchart illustrating a flow of manual control over the hydraulic excavator according to Embodiment 1.

FIG. 11 is a flowchart illustrating a flow of processing by the machine body controller 51 at the time of the manual control. In Procedure S41, the target action generation section 51*c* computes the target velocities of the hydraulic cylinders 18*a*, 18*b*, and 18*c* on the basis of the operation amount (pressure value) of each operation lever input from the operation device 44.

In Procedure S42, the actuator control section 51*d* computes the control signal (for example, command current) for driving each control valve 47 on the basis of the target velocity of each hydraulic cylinder computed in Procedure S41, and outputs the control signal to the corresponding control valve 47. In the ordinary manual control, the actuator control section 51*d* outputs the control signal to set maximum the opening degree of each of the control valves 47*a*, 47*b*, 47*c*, 47*f*, and 47*g* (release each of the control valves 47*a*, 47*b*, 47*c*, 47*f*, and 47*g*) and to set minimum the opening degree of each of the control valves 47*d*, 47*e*, and 47*h* (shut off each of the control valves 47*d*, 47*e*, and 47*h*). The pilot pressures from the operation levers 44 are thereby fed to the directional control valve 45 as they are, thus making a state in which the work device 4 can be operated in accordance with the operator's operation.

In Procedure S43, the target action generation section 51*c* determines whether a control switchover instruction (which is output in a case in which the third state switching signal is input to the state transition section 51*a*) for switching the manual control to the semiautomatic control is input from the state transition section 51*a*. In a case in which the control switchover instruction is input, the semiautomatic control described with reference to FIG. 9 is executed. On the other hand, in a case in which the control switchover instruction is not input, the processing returns to first Procedure S41, and the manual control is continued.

While control corresponding to the velocity transition control of FIG. 10 is not exercised at a time of transition from the manual control to the semiautomatic control in the present embodiment, similar velocity transition control may be exercised in the case of transition from the manual control to the semiautomatic control.

Figure 12:
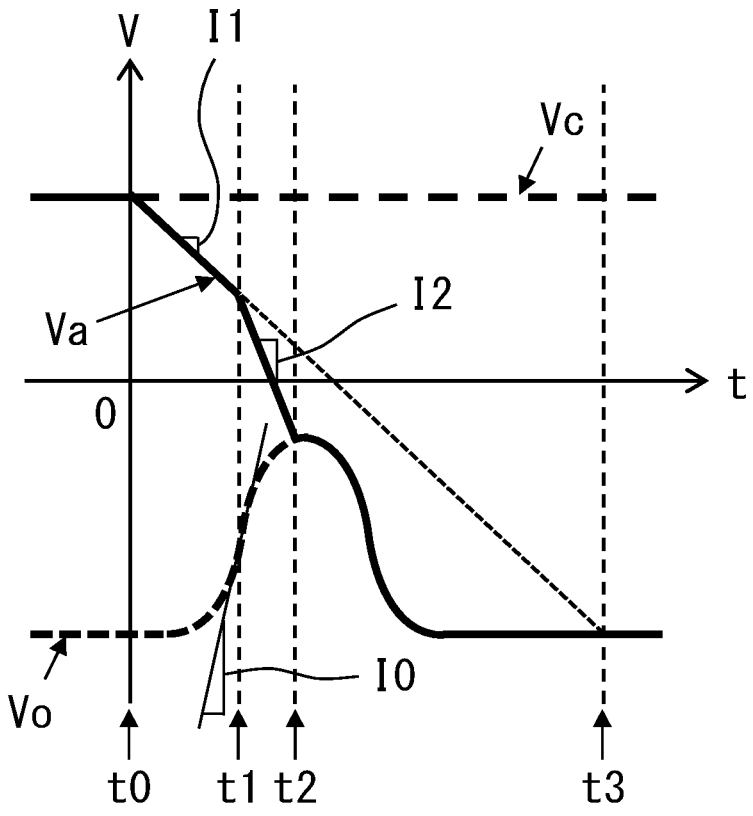
FIG. 12 is a diagram depicting a change in a boom cylinder velocity of the hydraulic excavator according to Embodiment 1.

FIG. 12 is a diagram depicting a change in the boom cylinder velocity at the time of switchover from the semiautomatic control to the manual control. A vertical axis indicates the boom cylinder velocity, a positive value represents an action velocity in the boom raising direction, and a negative value represents an action velocity in the boom lowering direction. A horizontal axis indicates the time t. FIG. 12 represents an aspect in which it is determined at the time t0 that it is necessary to switch the semiautomatic control to the manual control, and in which the boom cylinder target velocity Va(t) changes over time from the target velocity Vc (=Va(0)) based on the semiautomatic control computed by the machine body controller 51 until the target velocity Vo(t) based on the operator's operation input to the operation lever 44*b*. Before the time t0, the semiautomatic control is exercised and the boom cylinder target velocity Va(t) is equal to the target velocity Vc based on the semiautomatic control.

At the clock time t0, the control switchover instruction to switch the semiautomatic control to the manual control is output from the state transition section 51*a* within the machine body controller 51 to the target action generation section 51*c*, and it is determined that it is necessary to switch the semiautomatic control to the manual control. Since the amount of change of the target velocity Vo(t) based on the operator's operation at the clock time t0 is generally zero and smaller than the velocity threshold I0 described above, the boom cylinder target velocity Va(t) is computed on the basis of Procedure S24 of FIG. 10. The rate of change in the boom cylinder target velocity Va(t) is thereby limited to the preset first rate of velocity change I1.

Since the rate of change in the target velocity Vo(t) based on the operator's operation is smaller than the threshold I0 from the clock time t0 to a clock time t1, the processing based on Procedure S24 is continued. However, at the clock time t1, the rate of change in the target velocity Vo(t) based on the operator's operation becomes equal to or greater than the threshold I0. The processing in Procedure S28 is thereby executed, and the value limiting the rate of change in the boom cylinder target velocity Va(t) is changed from the first rate of velocity change I1 to the second rate of velocity change I2. It is noted that the second rate of velocity change I2 is a value greater (value permitting a greater change per time) than the first rate of velocity change I1.

At a clock time t2, the boom cylinder target velocity Va(t) is equal to the target velocity Vo(t) based on the operator's operation, and the semiautomatic control is completely switched to the manual control (transition to the control of FIG. 11). Since the manual control to cause the work device 4 to be actuated in accordance with the operator's operation input is exercised at and after the clock time t2, the boom cylinder target velocity Va(t) is equal to the target velocity Vo(t) based on the operator's operation.

The change in the target velocity Vo(t) based on the operator's operation over time depicted in FIG. 12 is on the premise of a situation in which the operator makes determination as in the following (1) to (3). In other words, (1) the operator desired to lower the boom 13 for the purpose of further excavation right after the work device 4 is actuated out of the range R where the design data is present at the clock time to. (2) However, in a case in which the semiautomatic control is impossible at the clock time t0, the operator predicted that boom 13 suddenly lowers in accordance with input of a boom lowering operation that is a condition for activating the semiautomatic control before the clock time t0, and operated the operation lever 44*b* to ease up the input of the boom lowering operation from the clock time t0 to t1. (3) However, the boom 13 does not promptly lower against the operator's prediction because of the limitations imposed on the rate of change in the target velocity Va(t) of the boom cylinder 18*a*. The operator, therefore, operates the operation lever 44*b* to strengthen the input of the boom lowering operation again at the clock time t2.

In the present embodiment, when the operation input to the operation device 44 is quickly changed during the velocity transition control exercised at the time of switchover between the two types of control different in a target velocity computing scheme, an operator's intention of an operation is regarded as being present, the velocity limiting value (first rate of velocity change I1) used during the velocity transition control is changed to the value (second rate of velocity change I2) greater than the velocity limiting value (first rate of velocity change I1) to relax the velocity limitations. As a result, it is possible to switch to the manual control at the clock time t2 earlier than a clock time t3 at which the semiautomatic control is completely switched to the manual control in a case of continuous use of the first rate of velocity change I1. In other words, the clock time at which the work device 4 can be operated at the operator's intended target velocity is quickened than before; thus, it is possible to suppress occurrence of the operator's feeling of strangeness due to the gap between the operator's operation and the actual boom action.

In this way, advantages of the present embodiment are that the operator's positive intention of the operation is read from the change in the operation input to the operation device 44, and the actual action of the work device 4 can be made closer to the operator's operation more quickly. On the other hand, if the operator's operation input is constant, it is unclear whether the operator's intention of an operation is present; thus, limitations with the first rate of change is continued. It is thereby possible to prevent the work device 4 from suddenly moving, ensure stability of the machine body, and quicken timing of reflecting the operator's operation in the action of the work device 4 in the case of the operator's positive intention of an operation; thus, it is possible to suppress the operator's feeling of strangeness for the gap between the operation and the action.

Embodiment 2

Embodiment 2 of the present invention will be described with reference to FIGS. 13 to 16. It is noted that different respects from those in Embodiment 1 will be described and parts not described herein are similar to those in Embodiment 2.

Figure 13:
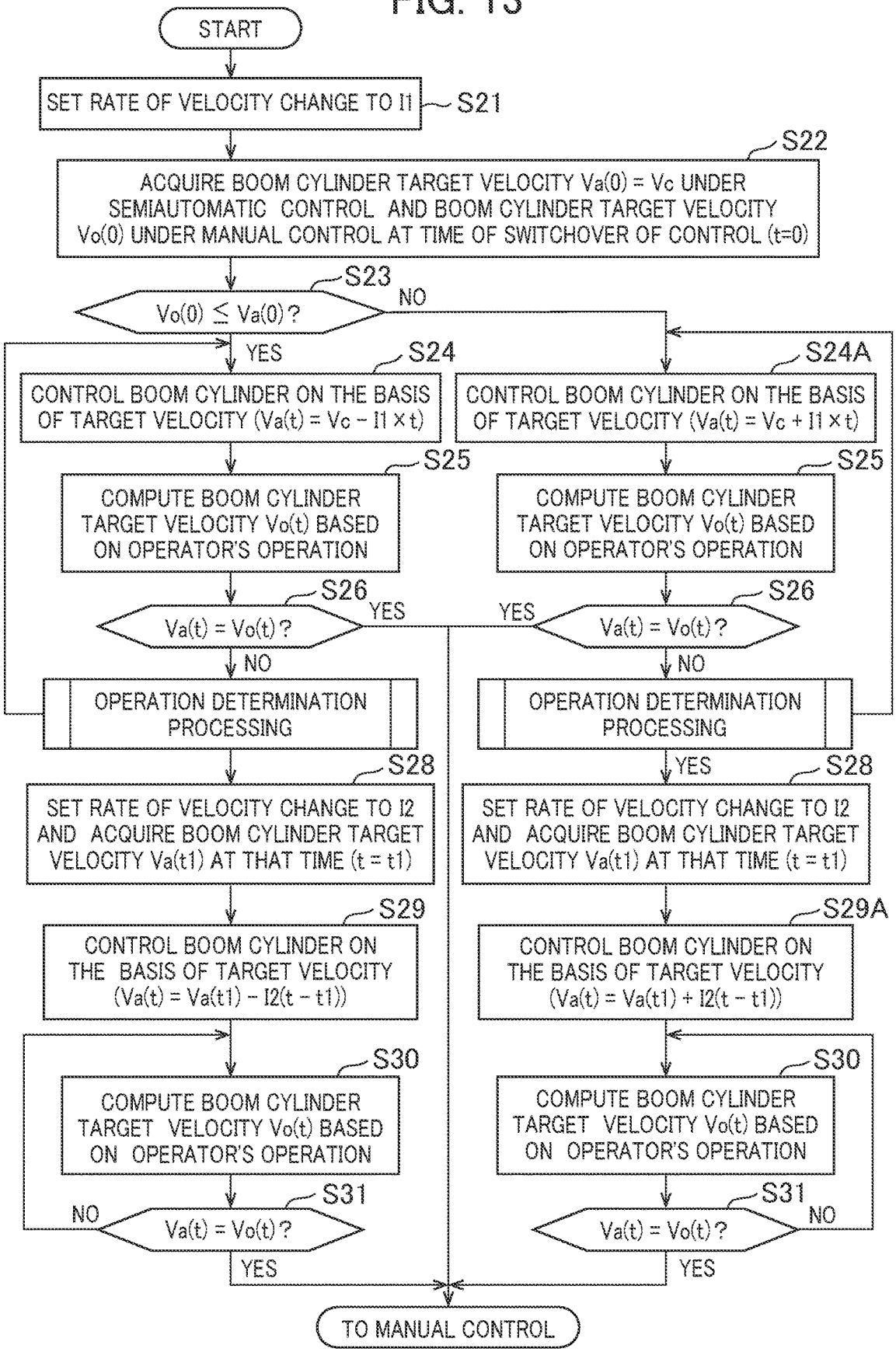
FIG. 13 is a flowchart illustrating a flow of velocity transition control over a hydraulic excavator according to Embodiment 2.

FIG. 13 is a flowchart illustrating a flow of processing (velocity transition control) by the machine body controller 51 at the time of switchover from the semiautomatic control to the manual control. FIG. 13 differs from FIG. 10 in that operation determination processing is performed as an alternative to Procedure S27. In Procedure S26, the target action generation section 51*c* determines whether Va(t) computed in Procedure S24 or Procedure S24A is equal to Vo(t) computed in Procedure S25. In the case in which Va(t) is not equal to Vo(t), the target action generation section 51*c* determines a state in which the velocity transition control is still necessary, and the operation determination processing depicted in FIG. 14 is started.

Figure 14:
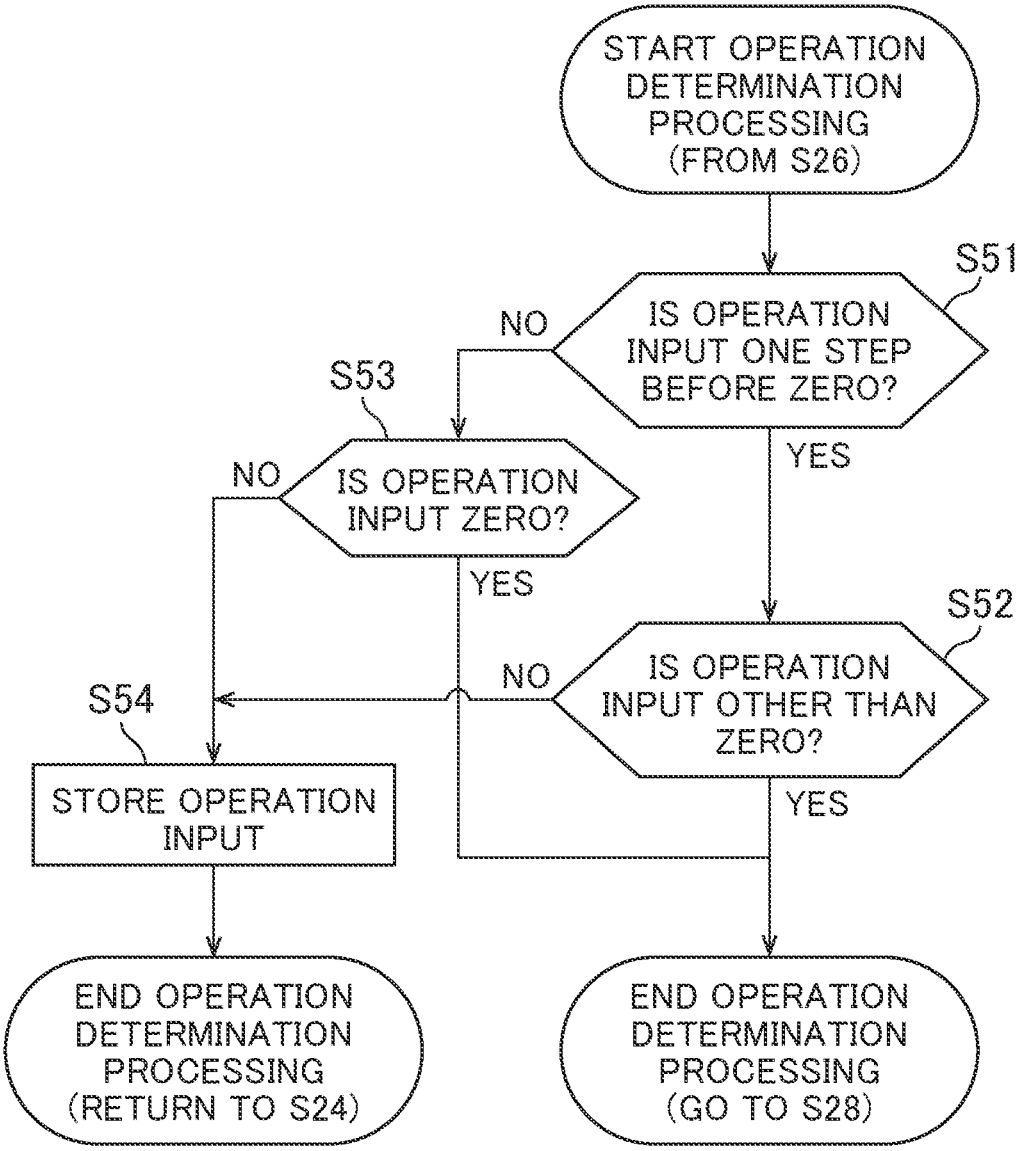
FIG. 14 is a flowchart illustrating a flow of operation determination processing on the hydraulic excavator according to Embodiment 2.

FIG. 14 is a flowchart illustrating a flow of the operation determination processing. In Procedure S51, the state transition section 51*a* determines whether an operator's operation input to the operation lever 44*b* stored in Procedure S54 of the operation determination processing one step before is zero. In a case in which the operation input one step before is zero, the processing goes to Procedure S52, and in a case in which the operation input one step before is other than zero, the processing goes to Procedure S53. It is noted that determination whether the operation input is zero performed herein may be determination whether a detection value of the hydraulic sensor 49*d* disposed immediately under the boom operation lever 44*b* and detecting a boom lowering pilot pressure fall within a range of a pressure when the operation lever 44*b* is neutral. In other words, whether the operation input is zero may be determined depending on whether the detection value of the hydraulic sensor 49*d* is equal to or smaller than a predetermined threshold. This also applies to other Procedures S52 and S53.

In Procedure S52, the state transition section 51*a* determines whether current operator's operation input to the operation lever 44*b* is other than zero. In a case in which the operation input is other than zero, the operation determination processing is ended, and the state transition section 51*a* goes to Procedure S28, and changes the rate of velocity change to the second rate of velocity change I2. On the other hand, in a case in which the operation input is zero, the state transition section 51*a* stores a current operation input value in Procedure S54 and returns to Procedure S24.

In Procedure S53, the state transition section 51*a* determines whether the current operator's operation input to the operation lever 44*b* is zero. In a case in which the operation input is zero, the state transition section 51*a* ends the operation determination processing, goes to Procedure S28, and changes the rate of velocity change to the second rate of velocity change I2. On the other hand, in a case in which the operation input is not zero, the state transition section 51*a* stores a current operation input value in Procedure S54 and returns to Procedure S24.

Functions and advantages of the present embodiment will be described with reference to FIGS. 15 and 16.

Figure 15:
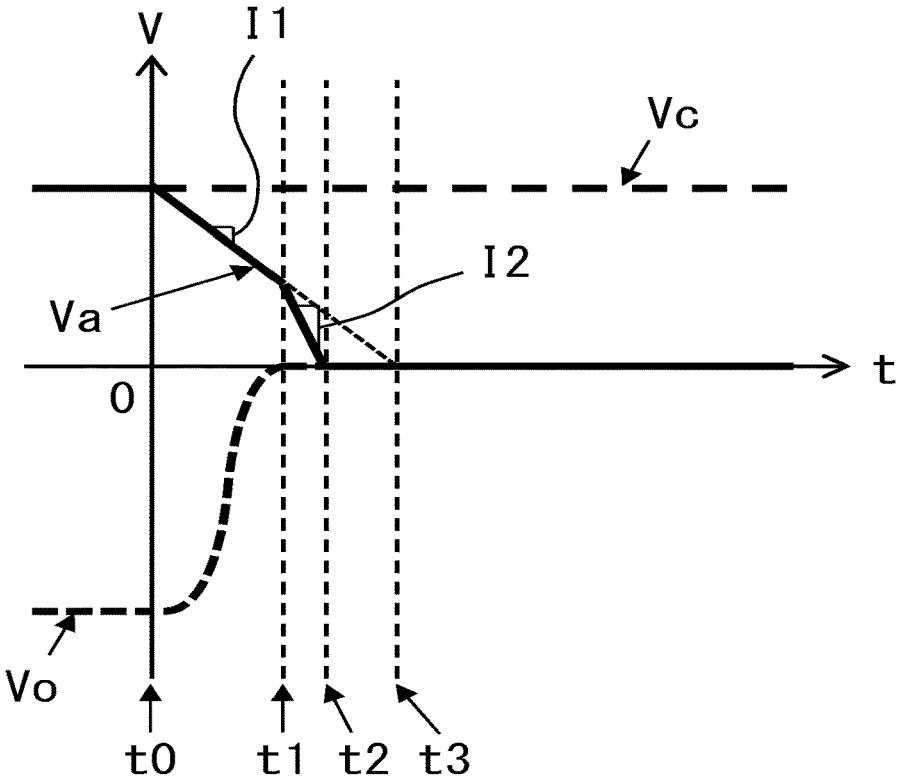
FIG. 15 is a diagram depicting a change in a boom cylinder velocity of the hydraulic excavator according to Embodiment 2.

FIG. 15 is a diagram depicting a first example of a change in the boom cylinder velocity at the time of switchover from the semiautomatic control to the manual control. A vertical axis indicates the boom cylinder velocity, a positive value represents an action velocity in the boom raising direction, and a negative value represents an action velocity in the boom lowering direction. A horizontal axis indicates the time t. FIG. 15 represents an aspect in which it is determined at the time t0 that it is necessary to switch the semiautomatic control to the manual control, and in which the boom cylinder target velocity Va(t) changes over time from the target velocity Vc (=Va(0)) based on the semiautomatic control computed by the machine body controller 51 until the target velocity Vo(t) based on the operator's operation input to the operation lever 44*b*. Before the time t0, the semiautomatic control is exercised and the boom cylinder target velocity Va(t) is equal to the target velocity Vc based on the semiautomatic control.

At the clock time t0, the control switchover instruction to switch the semiautomatic control to the manual control is output from the state transition section 51*a* within the machine body controller 51 to the target action generation section 51*c*, and it is determined that it is necessary to switch the semiautomatic control to the manual control. At each of the clock time t0 and a clock time one step before, the target velocity Vo(t) based on the operator's operation is lower than zero and the operation input to the operation lever 44*b* is not zero. Owing to this, in the operation determination processing of FIG. 14, the processing goes to Procedures S51, S53, and S54 and returns to Procedure S24. In other words, the rate of change in the boom cylinder target velocity Va(t) is kept to the preset first rate of velocity change I1. Subsequently, until the clock time t1, similarly to the clock time t0, the target velocity Vo(t) based on the operator's operation is lower than zero; thus, the processing for limiting the boom cylinder velocity is continued at the first rate of velocity change I1.

At the clock time t1, the target velocity Vo(t) based on the operator's operation is zero and the operation input to the operation lever 44*b* is zero. Furthermore, the target velocity Vo(t) based on the operator's operation at the clock time one step before is lower than zero and the operation input to the operation lever 44*b* is not zero. Owing to this, in the operation determination processing of FIG. 14, the processing goes to Procedures S51 and S53 and then goes to Procedure S28. The value limiting the rate of change in the boom cylinder target velocity Va(t) is thereby changed from the first rate of velocity change I1 to the second rate of velocity change I2. The second rate of velocity change I2 is a value greater (value permitting a greater change per time) than the first rate of velocity change I1.

At the clock time t2, the boom cylinder target velocity Va(t) is equal to the target velocity Vo(t) based on the operator's operation, and the semiautomatic control is completely switched to the manual control (transition to the control of FIG. 11). Since the manual control to cause the work device 4 to be actuated in accordance with the operator's operation input is exercised at and after the clock time t2, the boom cylinder target velocity Va(t) is equal to the target velocity Vo(t) based on the operator's operation.

Meanwhile, the change in the target velocity Vo(t) based on the operator's operation over time depicted in FIG. 15 is on the premise of a situation in which the operator thinks of, for example, promptly stopping the boom raising action right after the work device 4 moves out of the range of the design data and returns the boom operation lever 44*b* to a neutral position between the clock times t0 and t1.

In the present embodiment, at the point in time (clock time t1) of returning the boom operation lever 44*b* operated at the clock time t0 of start of the switchover from the semiautomatic control to the manual control to the neutral position, an operator's intention to positively stop the boom action is regarded as being present, the velocity limiting value (first rate of velocity change I1) used during the velocity transition control is changed to the value (second rate of velocity change I2) greater than the velocity limiting value (first rate of velocity change I1) to relax the velocity limitations. As a result, it is possible to stop the boom action at the clock time t2 earlier than the clock time t3 at which the semiautomatic control is completely switched to the manual control in the case of continuous use of the first rate of velocity change I1. In other words, the timing of completion with the operator's intended stop of the boom action is quickened; thus, it is possible to suppress occurrence of the operator's feeling of strangeness due to the gap between the operator's operation and the actual boom action.

Figure 16:
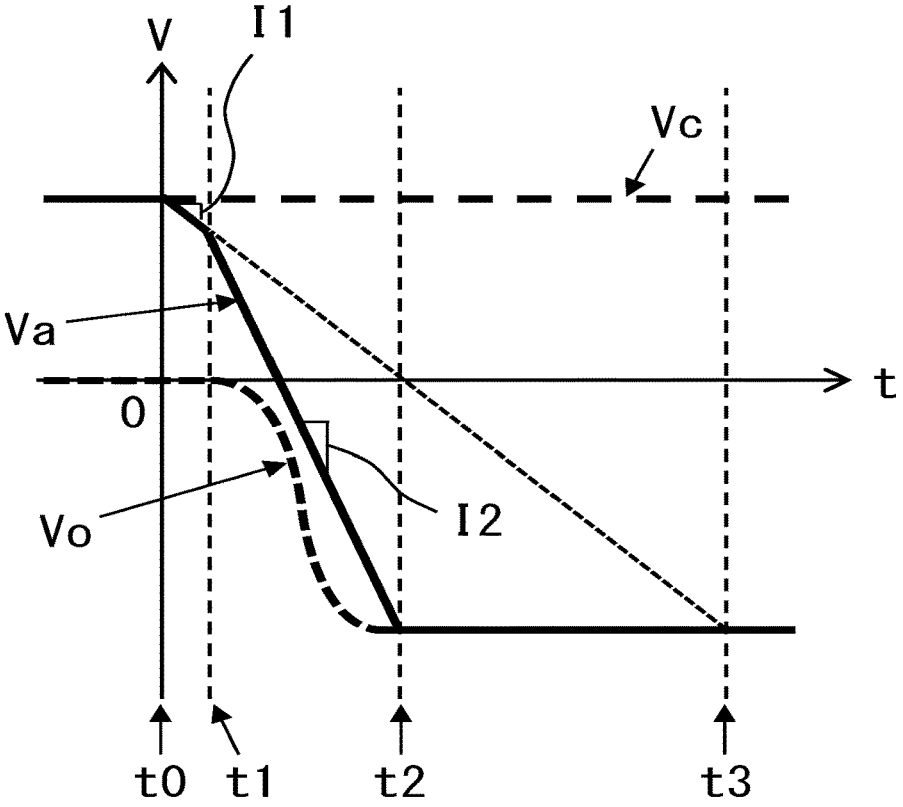
FIG. 16 is a diagram depicting a change in the boom cylinder velocity of the hydraulic excavator according to Embodiment 2.

FIG. 16 is a diagram depicting a second example of a change in the boom cylinder velocity at the time of switchover from the semiautomatic control to the manual control.

At the clock time t0, the control switchover instruction to switch the semiautomatic control to the manual control is output from the state transition section 51*a* within the machine body controller 51 to the target action generation section 51*c*, and it is determined that it is necessary to switch the semiautomatic control to the manual control. At each of the clock time t0 and the clock time one step before, the target velocity Vo(t) based on the operator's operation is zero and the operation input to the operation lever 44*b* is zero. Owing to this, in the operation determination processing of FIG. 14, the processing goes to Procedures S51, S52, and S54 and returns to Procedure S24. In other words, the rate of change in the boom cylinder target velocity Va(t) is kept to the preset first rate of velocity change I1. Subsequently, until the clock time t1, similarly to the clock time t0, the target velocity Vo(t) based on the operator's operation is kept to zero; thus, the processing for limiting the boom cylinder velocity is continued at the first rate of velocity change I1.

At the clock time t1, the target velocity Vo(t) based on the operator's operation is smaller than zero and the operation input to the operation lever 44*b* is not zero. Furthermore, at the clock time one step before, the target velocity Vo(t) based on the operator's operation is zero and the operation input to the operation lever 44*b* is also zero. Owing to this, in the operation determination processing of FIG. 14, the processing goes to Procedures S51 and S52 and then goes to Procedure S28. The value limiting the rate of change in the boom cylinder target velocity Va(t) is thereby changed from the first rate of velocity change I1 to the second rate of velocity change I2. The second rate of velocity change I2 is a value greater (value permitting a greater change per time) than the first rate of velocity change I1.

At the clock time t2, the boom cylinder target velocity Va(t) is equal to the target velocity Vo(t) based on the operator's operation, and the semiautomatic control is completely switched to the manual control (transition to the control of FIG. 11). Since the manual control to cause the work device 4 to be actuated in accordance with the operator's operation input is exercised at and after the clock time t2, the boom cylinder target velocity Va(t) is equal to the target velocity Vo(t) based on the operator's operation.

Meanwhile, the change in the target velocity Vo(t) based on the operator's operation over time depicted in FIG. 16 is on the premise of a situation in which the operator conducts work under the semiautomatic control without input of the boom lowering operation because the bucket 15 or the bucket tip end 150 moves out of the range R where the design data is present before the posture of the work device 4 becomes the orthogonal posture or the like, but in which the operator desires to lower the boom 15 for further excavation or the like right after the work device 4 moves out of the range of the design data.

In the present embodiment, at the point in time (clock time t1) of inputting the operation to the boom operation lever 44*b* preset at the neutral position at the clock time t0 of start of the switchover from the semiautomatic control to the manual control, an operator's intention to positively operate the boom 13 is regarded as being present, the velocity limiting value (first rate of velocity change I1) used during the velocity transition control is changed to the value (second rate of velocity change I2) greater than the velocity limiting value (first rate of velocity change I1) to relax the velocity limitations. As a result, it is possible to start the boom operation at the clock time t2 earlier than the clock time t3 at which the semiautomatic control is completely switched to the manual control in the case of continuous use of the first rate of velocity change I1. In other words, the timing of starting the operator's intended boom operation is quickened; thus, it is possible to suppress occurrence of the operator's feeling of strangeness due to the gap between the operator's operation and the actual boom action.

It is noted that in the above description of Embodiment 2, it has been described with reference to FIGS. 15 and 16 that the rate of change with time in the target velocity Va(t) of the boom cylinder 18*a* is changed from the first rate of change I1 to the second rate of change I2 in either the case in which the input to the boom operation lever 44*b* changes from input in the boom lowering direction (negative input value in FIGS. 15 and 16) to the neutral position (zero input value in FIGS. 15 and 16) or the case in which the input to the boom operation lever 44*b* changes from the neutral position (zero input value) to input in the boom lowering direction (negative input value) since the switchover of the control from the semiautomatic control to the manual control is started at the clock time t0 until the target velocity Va(t) of the boom cylinder 18*a* changes to the target velocity Vo(t) based on the operator's operation. However, it goes without saying that, as obvious from configurations of the flowcharts of FIGS. 13 and 14, the work machine is configured in such a manner that the rate of change with time in the target velocity Va(t) of the boom cylinder 18*a* also is changed from the first rate of change I1 to the second rate of change I2 in either a case in which the input to the boom operation lever 44*b* changes from input in the boom raising direction (positive input value) to the neutral position (zero input value) or a case in which the input to the boom operation lever 44*b* changes from the neutral position (zero input value) to input in the boom raising direction (positive input value) since the switchover of the control from the semiautomatic control to the manual control is started at the clock time t0 until the target velocity Va(t) of the boom cylinder 18*a* changes to the target velocity Vo(t) based on the operator's operation.

<Others>

An instance of outputting the first state switching signal and an instance of outputting the second state switching signal have been described above without distinction. However, since the first state switching signal is output irrespectively of an operator's intention, forced switchover from the semiautomatic control to the manual control is performed irrespectively of the operator's intention in the instance of outputting the first state switching signal. Owing to this, it can be pointed out that switchover of control can be easily performed while the work device 4 is operated and the operator is, therefore, liable to have a feeling of strangeness for the velocity limitations during the velocity transition control, compared with a case of spontaneously outputting the second state switching signal using the selector switch 56. It can be, therefore, said that the advantages of the above embodiments that changing the input to the operation device 44 during the velocity transition control makes it possible to quicken the timing at which the operator's operation is reflected in the action of the work device 4 are conspicuous in the instance of outputting the first state switching signal.

While the case of controlling the boom cylinder 18*a* by the semiautomatic control has been described above, the present invention is also applicable to a case of controlling the other hydraulic cylinders (arm cylinder 18*b* and bucket cylinder 18*c*) by the semiautomatic control under a predetermined condition.

While it has been described above that the condition for transition from the velocity transition control to the manual control (FIG. 11) is that the two velocities Va(t) and Vo(t) are equal to each other in Procedures S26 and S31 of FIGS. 10 and 13, flowcharts may be configured in such a manner that the velocity transition control transitions into the manual control of FIG. 11 when a difference between the two velocities Va(t) and Vo(t) is equal to or smaller than a predetermined threshold.

While it has been described above that the velocity transition control is executed at the time of the switchover from the semiautomatic control to the manual control, the velocity transition control may be executed similarly at the time of the switchover from the manual control to the semiautomatic control.

While a case in which the absolute value of the rate of change in the operation input to the operation device is equal to or greater than I'0, a case in which a state in which the operation input to the operation device 44 is present changes to a state in which the operation input thereto is not present (that is, neutral position), and a case in which the state in which the operation input thereto is not present changes to the state in which the operation input thereto is present have been mentioned as specific examples of a change in the input to the operation device 44 functioning as a trigger to change the rate of change with time of the target velocity Va(t) of the boom cylinder 18*a* from the first rate of change 11 to the second rate of change I2, the rate of change may be changed with other change in the input used as a trigger.

The present invention is not limited to the embodiments but encompasses various modifications without departing from the spirit of the invention. For example, the present invention is not limited to the work machine configured with all the configurations described in the embodiments but encompasses the work machine from which part of the configurations are deleted. Furthermore, a part of the configurations according to a certain embodiment can be added to or can be replaced with configurations according to the other embodiment.

Furthermore, a part of or entirety of the configurations related to the various controllers 51, 52, and 53 and functions, execution processes, and the like of the configurations may be realized by hardware (by designing logic for executing the functions, for example, by an integrated circuit, or the like). Moreover, the configurations related to the controllers 51, 52, and 53 may be a program (software) for realizing the functions related to the configurations of the controllers 51, 52, and 53 by causing an arithmetic processor (for example, a CPU) to read/execute the program. Data related to the program can be stored in, for example, a semiconductor memory (such as a flash memory or an SSD), a magnetic storage device (such as a hard disk drive), or a recording medium (such as a magnetic disk or an optical disk).

Furthermore, in the description in each of the embodiments, control lines or data lines considered to be necessary for the description are illustrated but all the control lines or the data lines related to products are not always illustrated. In actuality, it may be contemplated that almost all the configurations are mutually connected.

DESCRIPTION OF REFERENCE CHARACTERS

1: Hydraulic excavator
2: GNSS antenna (position sensor)
3: IMU (posture sensor)
4: Work device (front work device)
11: Upper swing structure
12: Lower track structure
13: Boom
14: Arm
140: Joint
15: Bucket
150: Bucket tip end
16, 17: Bucket link
18: Hydraulic cylinder (actuator)
19: Swing hydraulic motor
41: Engine
42, 43: Hydraulic pump
44: Operation lever (operation device)
45: Directional control valve
46: Shut-off valve
47: Control valve
48: Shuttle valve
49: Pressure sensor
51: Machine body controller
51*a*: State transition section
51*b*: Velocity transition section
51*c*: Target action generation section
51*d*: Actuator control section
52: Guidance controller
52*a*: Work device position/posture computing section
52*b*: Design data storage section
52*c*: Design surface computing section
52*d*: Guidance state management section
53: GNSS controller
54: Guidance monitor
55: Speaker
61, 61: Design surface

The invention claimed is:

1. A work machine comprising:
a work device;
an actuator that drives the work device;
an operation device for operating the actuator; and
a controller that controls the actuator by any of two types of control that are first control to control the actuator on a basis of input to the operation device and second control to control the actuator on a basis of a distance between a predetermined design surface and the work device while the operation device is operated, wherein
the controller
sets a limiting value for a rate of change with time in a velocity of the actuator to a first rate of change in case that switchover between the two types of control is performed on a basis of input of a state switching signal and the velocity of the actuator changes from a velocity specified by the control before the switchover out of the two types of control to a velocity specified by the control after the switchover, and
changes the rate of change with time in the velocity of the actuator from the first rate of change to a second rate of change greater than the first rate of change in a case in which input to the operation device changes since the switchover between the two types of control is performed on the basis of the input of the state switching signal until the velocity of the actuator changes to the velocity specified by the control after the switchover.

2. The work machine according to claim 1, wherein the controller changes the rate of change with time in the velocity of the actuator from the first rate of change to the second rate of change in a case in which a rate of change with time of the input to the operation device is equal to or higher than a predetermined threshold since the switchover between the two types of control is performed on the basis of the input of the state switching signal until the velocity of the actuator changes to the velocity specified by the control after the switchover.

3. The work machine according to claim 1, wherein types of the input to the operation device include a positive input value that is an input value in a case of operating the actuator in a first direction, a negative input value that is an input value in a case of operating the actuator in a second direction, and a zero input value that is an input value in a case of not operating the actuator in any of the first direction and the second direction, and the controller changes the rate of change with time in the velocity of the actuator from the first rate of change to the second rate of change in either a case in which the input to the operation device changes from any of the positive input value and the negative input value to the zero input value or a case in which the input to the operation device changes from the zero input value to any of the positive input value and the negative input value since the switchover between the two types of control is performed on the basis of the input of the state switching signal until the velocity of the actuator changes to the velocity specified by the control after the switchover.

4. The work machine according to claim 1, wherein the controller determines whether an abnormality occurs in hardware and software necessary to control the actuator by the second control, and outputs the state switching signal in a case of determining that the abnormality occurs while the actuator is controlled by the second control.

5. The work machine according to claim 4, wherein the controller determines whether the work device is present in a region where the design surface is present, and outputs the state switching signal in a case of determining that the work device is present out of the region where the design surface is present while the actuator is controlled by the second control.

6. The work machine according to claim 4, wherein the controller determines whether an abnormality occurs in any of a posture sensor for the work device and a position sensor for the work machine, and outputs the state switching signal in a case of determining that the abnormality occurs in any of the posture sensor and the position sensor while the actuator is controlled by the second control.

7. The work machine according to claim 4, further comprising:

a control valve that generates a pilot pressure to be output to a directional control valve of the actuator at a time of the second control, on a basis of a control signal output from the controller; and a pressure sensor that detects the pilot pressure, wherein the controller determines whether an abnormality occurs in the control valve by comparing a pressure value specified by the control signal with a pressure value detected by the pressure sensor, and outputs the state switching signal in a case of determining that the abnormality occurs in the control valve while the actuator is controlled by the second control.

8. The work machine according to claim 2, wherein the predetermined threshold is a value greater than the first rate of change.

* * * * *